US007896466B2

(12) United States Patent
Murayama et al.

(10) Patent No.: US 7,896,466 B2
(45) Date of Patent: Mar. 1, 2011

(54) PRINTING APPARATUS AND PRINTING METHOD

(75) Inventors: Yoshiaki Murayama, Setagaya-ku (JP); Kiichiro Takahashi, Yokohama (JP); Minoru Teshigawara, Yokohama (JP); Tetsuya Edamura, Kawasaki (JP); Akiko Maru, Minato-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 1187 days.

(21) Appl. No.: 11/536,309

(22) Filed: Sep. 28, 2006

(65) Prior Publication Data

US 2007/0019031 A1 Jan. 25, 2007

Related U.S. Application Data

(63) Continuation of application No. PCT/JP2006/313592, filed on Jul. 7, 2006.

(30) Foreign Application Priority Data

Jul. 8, 2005 (JP) ..... 2005-200150

(51) Int. Cl.
*B41J 2/21* (2006.01)
*B41J 2/205* (2006.01)
*B41J 29/38* (2006.01)

(52) U.S. Cl. ..... 347/43; 347/15; 347/9

(58) Field of Classification Search ..... 347/9, 15, 347/40, 41, 43

See application file for complete search history.

(56) References Cited

U.S. PATENT DOCUMENTS

| | | | |
|---|---|---|---|
| 5,633,663 | A | 5/1997 | Matsubara et al. |
| 5,818,474 | A | 10/1998 | Takahashi et al. |
| 5,975,678 | A | 11/1999 | Kanematsu et al. |
| 6,042,212 | A | 3/2000 | Takahashi et al. |
| 6,130,685 | A | 10/2000 | Matsubara et al. |
| 6,142,598 | A | 11/2000 | Iwasaki et al. |
| 6,250,737 | B1 | 6/2001 | Matsubara et al. |
| 6,454,390 | B1 | 9/2002 | Takahashi et al. |
| 6,474,767 | B1 | 11/2002 | Teshigawara et al. |
| 6,532,026 | B2 | 3/2003 | Takahashi et al. |
| 6,557,964 | B2 | 5/2003 | Kawatoko et al. |
| 6,601,939 | B2 | 8/2003 | Fujita et al. |
| 6,665,091 | B1 | 12/2003 | Saruta |
| 6,682,168 | B2 | 1/2004 | Nakagawa et al. |
| 6,834,936 | B2 | 12/2004 | Teshigawara et al. |
| 2006/0038850 | A1 | 2/2006 | Teshigawara et al. |

FOREIGN PATENT DOCUMENTS

| | | | |
|---|---|---|---|
| JP | 5-278232 | A | 10/1993 |
| JP | 7-52389 | A | 2/1995 |
| JP | 11-208029 | A | 8/1999 |
| JP | 2002-144522 | A | 5/2002 |
| JP | 2003-53962 | A | 2/2003 |
| JP | 2004-114694 | A | 4/2004 |
| JP | 2004-255806 | A | 9/2004 |

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

A smooth, uniform image is produced by minimizing the occurrence of satellites of secondary color and dispersing landing positions of the satellites as uniformly as possible. For this purpose, the printing operation performed so that satellites of the two inks (cyan and magenta ink, foe example) ejected toward the same pixel are separated and landed on opposite sides of the main dots on the same pixel. This makes the distribution of satellites uniform and makes individual satellites less noticeable, maintaining the uniformity of an image.

6 Claims, 33 Drawing Sheets

MASK PATTERN A

PRINTING APPARATUS AND PRINTING METHOD

CROSS REFERENCE TO RELATED APPLICATIONS

This application is a continuation of International Application No. PCT/JP2006/313592, filed on Jul. 7, 2006. The entire disclosure of this prior application is incorporated by reference herein.

BACKGROUND OF THE INVENTION

1. Field of the Invention

The present invention relates to an ink jet printing apparatus and method to form a uniform image.

2. Description of the Related Art

A printing apparatus of an ink jet printing system (hereinafter referred to as an ink jet printing apparatus) performs a printing operation by ejecting ink from a print head onto a print medium and can easily be upgraded to a higher resolution, compared with other printing systems. The ink jet printing apparatus also has advantages of high speed printing capability, low noise and low cost. As there are growing needs for color output in recent years, a printing apparatus capable of producing high-quality printed images matching silver salt pictures in quality has been developed.

The ink jet printing apparatus incorporates a print head having a plurality of print elements (electrothermal transducer or piezoelectric element) densely arrayed therein for higher printing speed. Also for a color printing capability, many printing apparatus are provided with a plurality of such print heads.

FIG. 1 shows a construction of main components of a general ink jet printing apparatus. In the figure, denoted 1101 are ink jet cartridges. Each of these has a combination of an ink tank containing one of four colors, black, cyan, magenta and yellow, and a print head 1102 corresponding to the ink.

FIG. 2 shows a group of the ejection openings for one color arrayed corresponding to the print elements of the print head 1102, as seen from a direction of arrow Z of FIG. 1. In the figure, denoted 1201 are ejecting openings that number d and are arranged at a density of D openings per inch (D dpi). Hereinafter, a constitution including a print element and an opening corresponding to that is referred to as a nozzle.

Referring again to FIG. 1, reference number 1103 represents a paper feed roller, which, together with an auxiliary roller 1104, holds a print medium P and rotates in the direction of arrow to feed the print medium P in the direction of arrow Y (subscan direction). Denoted 1105 are a pair of supply rollers that supply the print medium P. The paired supply rollers 1105, as with the rollers 1103 and 1104, hold the print medium P between them and rotate at a slightly lower speed than the paper feed roller 1103, thereby applying an adequate level of tension to the print medium.

Denoted 1106 is a carriage that supports the four ink jet cartridges 1101 and moves them as the cartridges perform a scan. The carriage 1106 stands by at a home position h shown with a dashed line when the printing operation is not performed or when a recovery operation on the print head 1102 is executed.

When a print start command is entered into the printing apparatus, the carriage 1106 standing by at the home position h moves in the X direction (main scan direction) and at the same time the print heads 1102 on the carriage eject inks at a predetermined frequency from the nozzles 1201, forming a band of image d/D inch wide on the print medium. After the first printing scan is finished and before the second printing scan starts, the paper feed roller 1103 rotates in the direction of arrow to feed the print medium a predetermined distance in the Y direction. These main printing scan and feeding operation are alternated repetitively to produce an image in a stepwise fashion.

Such an ink jet printing apparatus often employs a multi-pass printing method. The multi-pass printing method will be briefly explained below.

In the multi-pass printing, image data that can be printed in one main printing scan is thinned by a mask pattern before executing the main printing scan. Further, in the next printing scan, image data that is thinned by a mask pattern complementary to the already used mask pattern is printed. Between each printing scan, a feed operation is performed to feed the print medium a distance shorter than the print width of the head.

In the case of a 2-pass printing, for example, a mask pattern used in each main printing scan thins the image data by about 50%. The distance that the print medium is fed by the feed operation is one-half the print width. By repeating the above printing operation, dots arrayed on a line leading to the main scan direction are printed by two different nozzles. Thus, since the print data is divided into halves and distributed among the two different nozzles, even if individual nozzles have some ejecting variations, an image produced is smoother than that produced by a 1-pass printing that does not use the multi-pass printing. Although the 2-pass printing has been explained here, the image produced by the multi-pass printing can be made smoother by increasing the number of passes (division number). This, however, results in an increased number of main printing scans and feed operations and therefore an increased output time. To reduce the output time as much as possible, a bidirectional multi-pass printing has become a mainstream in recent years which ejects ink in both forward and backward directions.

When ink is ejected from the nozzles of the ink jet print head, fine sub droplets of ink may be ejected along with main droplets that are intended to form an image. In the following description, dots formed by the main droplets are called main dots and dots formed by sub droplets satellites. The above relation between the main droplet and the sub droplet holds in one ejection. The one ejection referred to here is an ejection performed in response to one electric signal. The sub droplet is characterized by a slower ejection speed and a smaller volume than those of the main droplet. It is noted, however, that the satellites are not always smaller in size than the main dots.

FIGS. 3A to 3D show landing positions on a print medium of a main dot and a satellite. In these figures, 1301 represents a main dot and 1302 a satellite. An arrow shown in an upper part of these figures indicates a direction in which a carriage moves during the ejection operation. An arrow shown in a lower part of the figures indicates a direction in which a droplet is ejected.

FIG. 3A shows dots formed when the direction of ejection is vertical to the print medium. Normally if the print head is not inclined, the ejection face of the print head is parallel to the print medium and the direction of ejection is therefore vertical. Generally the sub droplet is slower in ejection speed than the main droplet and therefore lands on the print medium lagging behind the main droplet. During ejection, the carriage is moving in the direction of arrow 1303 in the figure, so the carriage speed is added to the ejection speed of the droplet, with the result that the landing time difference results in a landing position difference in the main scan direction.

FIG. 3B illustrates dots formed when the direction of ejection includes a component of the carriage movement. If the ink droplet ejection direction has some inclination due to various factors, such as a nozzle material swelling or the ink to be ejected being pulled into the liquid chamber, the ejection face of the head is not parallel to the print medium, forming dots as shown in FIG. 3B. In that case, the velocity components of the main droplet and sub droplet are each given the component of arrow 1304. Thus, the distance between the main dot 1301 and the satellite 1302 in the main scan direction further increases.

FIG. 3C illustrates dots formed when the ejection direction has an inclination opposite to that of FIG. 3B and includes a component (arrow 1305) opposite to the direction of carriage movement. In this case, the velocity components of the main droplet and sub droplet are the ejection direction component 1305 subtracted from the carriage velocity component 1303. Thus, the distance between the main dot 1301 and the satellite 1302 is shorter than that of FIG. 3A. FIG. 3C shows the satellite contained in the main dot when they land.

FIG. 3D illustrates dots formed when the velocity component is the same as that of FIG. 3C but the volume of a sub droplet is smaller. Sub droplets tend to have a smaller ejection speed as their volume decreases. Thus, the smaller the sub droplet, the larger the landing time difference between the sub droplet and the main droplet and therefore their distance. FIG. 3D shows a satellite formed separate from the main dot because of a larger landing time difference between the main droplet and the sub droplet than that of FIG. 3C.

As described above, the print position of satellite varies depending on various factors. When a bidirectional multi-pass printing is performed, dots formed in the forward scan and dots formed in the backward scan mix in the same image area (for example, the same pixel, the same pixel line or the same pixel area having M×N pixel).

FIG. 4 shows a variety of dot landing states when a bidirectional multi-pass printing is performed on a 2×2-pixel area. It is seen that the printed positions of satellites are inverted relative to the main dots depending on whether individual pixels are printed in the forward or backward main scan. In FIG. 4, a right-pointing arrow denotes a forward direction, a large circle with diagonal lines denotes a main dot printed by the carriage scanning in the forward direction, and a small circle with diagonal lines denotes a satellite printed by the carriage scanning in the forward direction. Furthermore a left-pointing arrow denotes a backward direction, a large white circle denotes a main dot printed by the carriage scanning in the backward direction, and a small white circle denotes a satellite printed by the carriage scanning in the backward direction.

As long as the satellites described above, if produced, are printed at the same position as the main dots or small enough compared with the main dots, no problem occurs in image quality. However, with a print head developed in recent years to eject very small ink droplets with high resolution, the main dots themselves have much smaller diameters and therefore the presence of satellites cannot be ignored. Particularly, when a secondary color is produced by overlapping two different inks, the problem becomes more serious.

FIGS. 5A to 5C show a case where cyan dots and magenta dots are overlapped to produce a blue color. As shown in the figure, two blue dots are formed in a 2×2-pixel area by moving the carriage in the direction of arrow. Here it is assumed that two print heads for cyan and magenta have the same satellite producing conditions. A satellite composed of two overlapping color dots is formed by the side of each blue dot formed of two main droplets. The satellites, formed by overlapping two different colors, are more conspicuous than when they are formed of a primary color, having greater effects on an image. If such distinctive satellites are produced unevenly, the uniformity is impaired, deteriorating the image quality.

To deal with the unevenness in landing position of satellites, some measures have already been proposed. For example, Japanese Patent Application Laid-open No. 2003-053962 discloses a technology that controls the feed distance of a print medium such that it includes at least an odd and even number of times the value of 1/D (D=printing resolution in the sub scan direction), in order to disperse the landing positions of satellites as possible and produce a uniform image.

With the method disclosed in the Japanese Patent Application Laid-open No. 2003-053962, however, a pixel in which satellites land on both sides of a main dots and a pixel in which satellites land insides of a main dots are arranged alternately. It is insufficiency for uniformity of image. Further, the method disclosed in the application provides a restriction on the control of transport distance of the print medium. Moreover, this technology does not take the secondary color described above into consideration, leaving the problem of easily noticeable secondary color satellites unsolved.

SUMMARY OF THE INVENTION

The present invention has been accomplished to solve the above-mentioned problems and it is an object of this invention to provide an ink jet printing method and an ink jet printing apparatus which can produce smooth, uniform images by minimizing the forming of satellites of secondary color as practically as possible and dispersing the landing positions of satellites as uniformly as possible.

The first aspect of the present invention is an ink jet printing apparatus for printing an image on a print medium by using a print head which can eject at least a first ink and a second ink, the second ink being different from the first ink at least in color or ejecting volume, the ink jet printing apparatus comprising: means for main-scanning the print head relative to the print medium in a forward direction and in a backward direction; and means for executing ejections of the first ink and the second ink toward a same pixel on the print medium in main scans of different directions; wherein a satellite of the first ink ejected toward the same pixel lands shifted in the forward or backward direction with respect to main dots of the first and second ink that land on the same pixel and a satellite of the second ink lands shifted, with respect to the main dots of the first and second ink, in a direction opposite the direction in which the satellite of the first ink shifts.

The second aspect of the present invention is an ink jet printing apparatus for printing an image on a print medium by using a print head having at least a first opening to eject a first ink and a second opening to eject a second ink, the second ink being different from the first ink at least in color or ejecting volume, the ink jet printing apparatus comprising: means for main-scanning the print head relative to the print medium in a forward direction and in a backward direction; and means for executing ejections of the first ink and the second ink toward the same pixel on the print medium in main scans of different directions; wherein a plurality of pixels toward that both the first and second ink are ejected comprise a first pixel toward that the first ink is ejected in the main scan of the forward direction and the second ink is ejected in the main scan of the backward direction and a second pixel toward that the first ink is ejected in the main scan of the backward direction and second ink is ejected in the main scan of the forward direction; wherein a satellite of the first ink lands shifted in the forward direction and a satellite of the second ink lands shifted in the backward direction, with respect to landing positions of main dots of the first and second ink printed on the first pixel; wherein a satellite of the first ink lands shifted in the backward direction and a satellite of the second ink lands shifted in the forward direction, with respect to landing positions of main dots of the first and second ink printed on the second pixel.

The third aspect of the present invention is an ink jet printing apparatus for printing an image on a print medium by using a print head which can eject at least a first ink and a second ink, the second ink being different from the first ink at least in color or ejecting volume, the ink jet printing apparatus comprising: means for main-scanning the print head relative to the print medium in a forward direction and in a backward direction; and means for executing, in main scans of different directions, ejections of the first ink and the second ink forward onto pixels adjoining in a direction perpendicular to the direction of main scans on the print medium; wherein a satellite of the first ink ejected toward the one of the adjoining pixels lands shifted in the forward or backward direction with respect to main dots of the first ink landed on the one pixel and a satellite of the second ink ejected toward the other of the adjoining pixels lands shifted, with respect to the main dots of the second ink landed on the other pixel, in a direction opposite the direction in which the satellite of the first ink shifts.

The fourth aspect of the present invention is an ink jet printing apparatus for printing an image on a print medium by using a print head having at least a first opening to eject a first ink and a second opening to eject a second ink, the second ink being different from the first ink at least in color or ejecting volume, the ink jet printing apparatus comprising: means for main-scanning the print head relative to the print medium in a forward direction and in a backward direction; and means for executing, in main scans of different directions, ejections of the first ink and the second ink onto pixels adjoining in a direction perpendicular to the direction of main scans on the print medium; wherein the adjoining pixels toward that the first and second ink are ejected comprise a first pixel toward that the first ink is ejected in the main scan of the forward direction and a second pixel toward that the second ink is ejected in the main scan of the backward direction; wherein a satellite of the first ink lands shifted in the forward direction, with respect to a landing position of a main dot of the first ink ejected toward the first pixel and satellite of the second ink lands shifted in the backward direction, with respect to a landing position of a main dot of the second ink ejected toward the second pixel.

The fifth aspect of the present invention is an ink jet printing method for printing an image on a print medium by using a print head which can eject at least a first ink and a second ink, the second ink being different from the first ink at least in color or ejecting volume, the ink jet printing method comprising the steps of: main-scanning the print head relative to the print medium in a forward direction and in a backward direction; and executing ejections of the first ink and the second ink onto the same pixel on the print medium in main scans of different directions; wherein a satellite of the first ink ejected toward the same pixel lands shifted in the forward or backward direction with respect to main dots of the first and second ink that land on the same pixel and a satellite of the second ink lands shifted, with respect to the main dots of the first and second ink, in a direction opposite the direction in which the satellite of the first ink shifts.

The sixth aspect of the present invention is an ink jet printing method to print an image on a print medium by using a print head which can eject at least a first ink and a second ink, the second ink being different from the first ink at least in color or ejecting volume, the ink jet printing method comprising the steps of: main-scanning the print head relative to the print medium in a forward direction and in a backward direction; and executing, in main scans of different directions, ejections of the first ink and the second ink toward pixels adjoining in a direction perpendicular to the direction of main scan on the print medium; wherein a satellite of the first ink ejected toward one of the adjoining pixels lands shifted in the forward or backward direction with respect to main dots of the first ink landed on the one pixel and a satellite of the second ink ejected toward the other of the adjoining pixels lands shifted, with respect to the main dots of the second ink landed on the other pixel, in a direction opposite the direction in which the satellite of the first ink shifts.

According to above construction, since landing positions of satellites are dispersed uniformly, images of higher level of uniformity are provided.

Further features of the present invention will become apparent from the following description of exemplary embodiments (with reference to the attached drawings).

DESCRIPTION OF THE EMBODIMENT

Now, by referring to the accompanying drawings, embodiments of this invention will be described in detail.

First Embodiment

Figure 1:
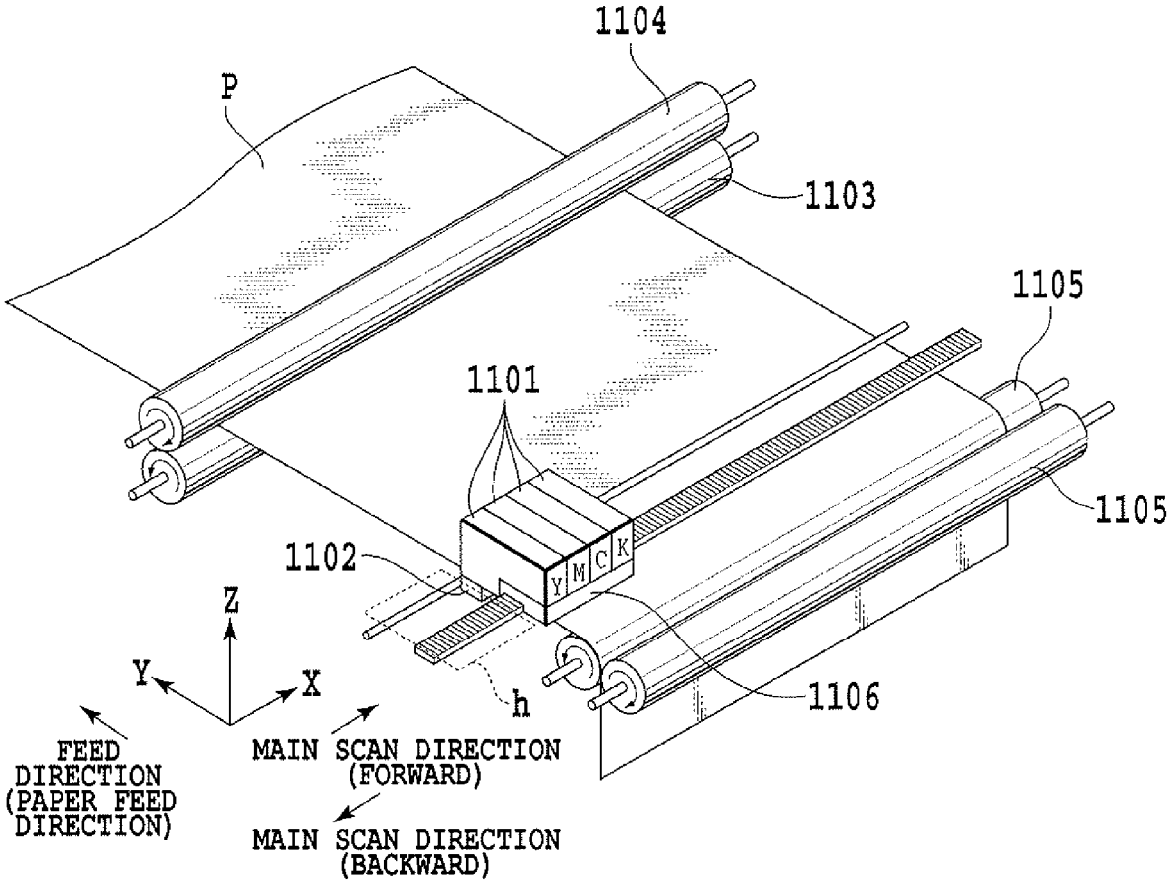
FIG. 1 illustrates a construction of main components of an ink jet printing apparatus applicable to the present invention.
Figure 2:
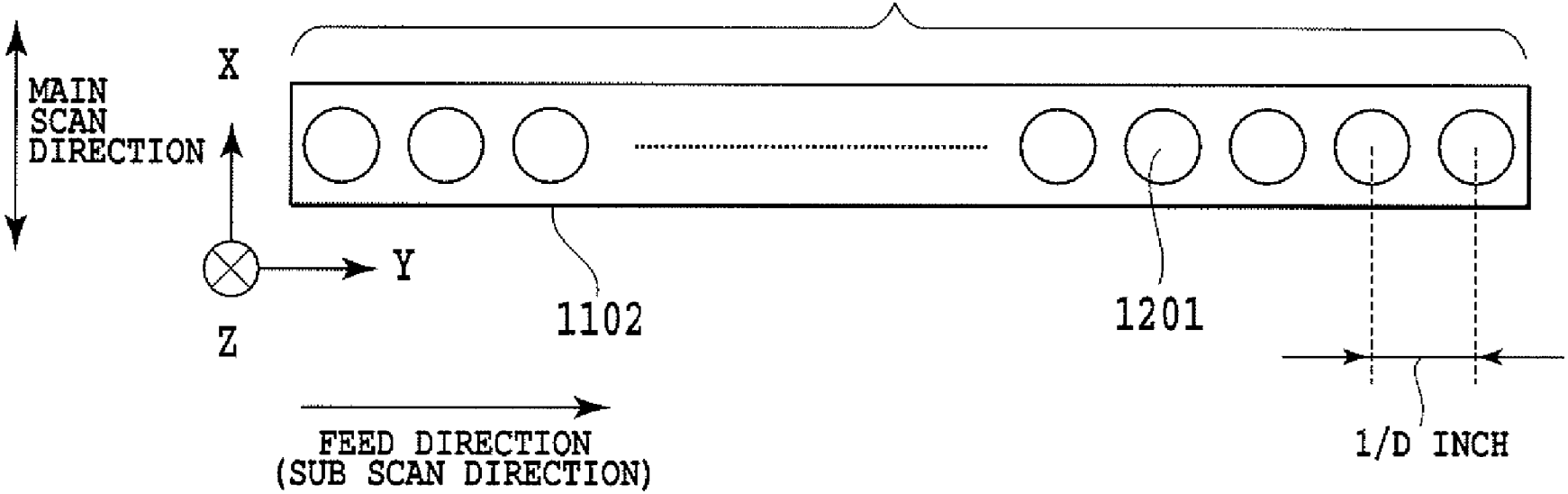
FIG. 2 is a schematic diagram showing nozzles for one color arranged in a print head.
Figure 3A:
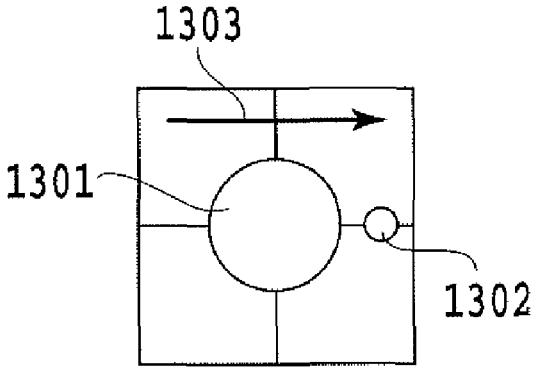
FIGS. 3A to 3D are explanatory views showing landing positions on a print medium of a main dot and a satellite.
Figure 3C:
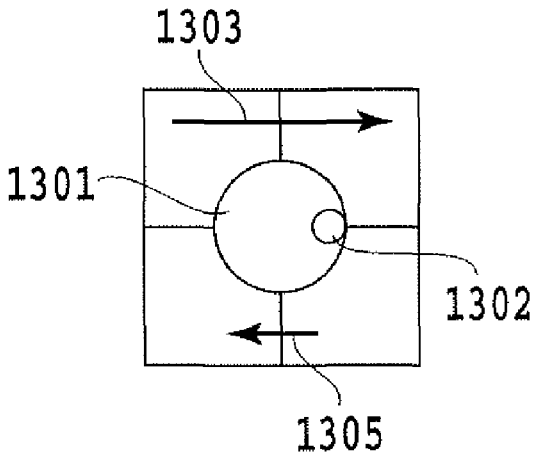
Figure 3B:
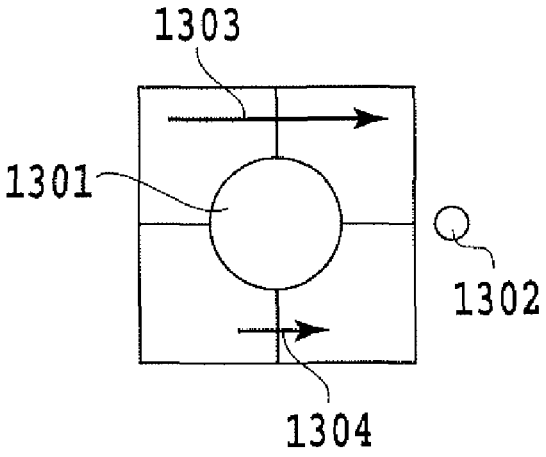
Figure 3D:
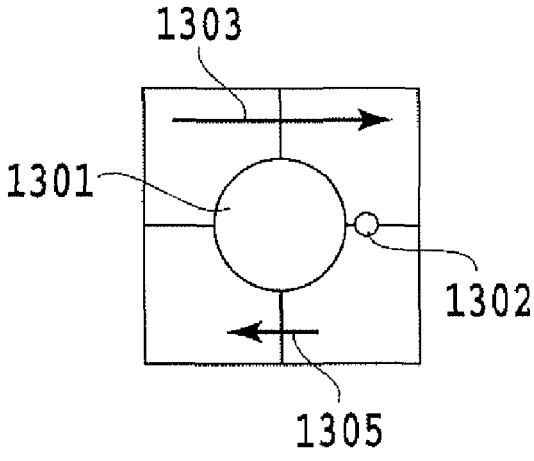
Figure 4:
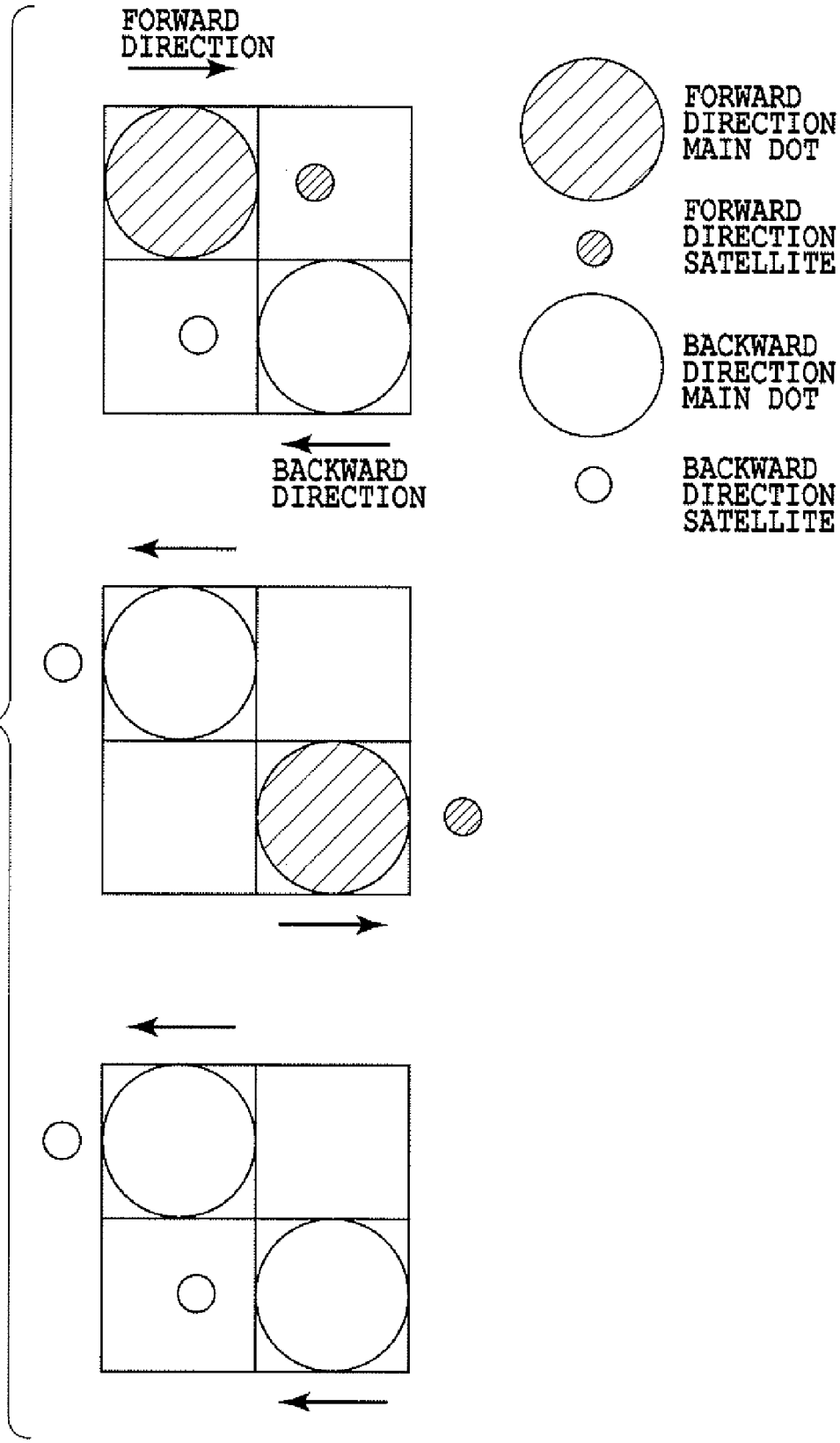
FIG. 4 illustrates various landing states when a bidirectional multi-pass printing is performed on a 2×2-pixel area.

This embodiment applies the ink jet printing apparatus described in FIG. 1.

Figure 6:
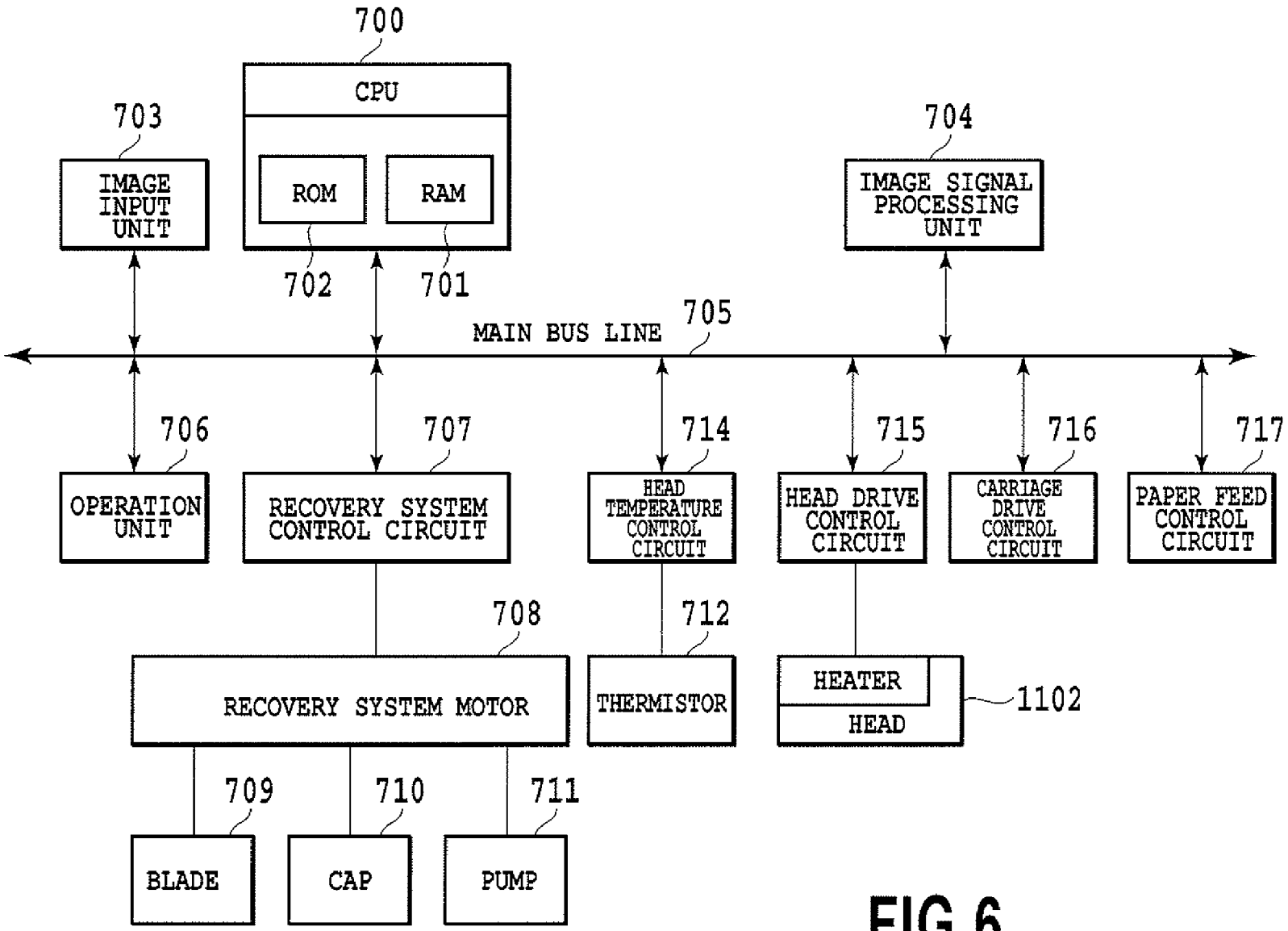
FIG. 6 is a block diagram showing a control configuration of the ink jet printing apparatus according to one embodiment of this invention.

FIG. 6 is a block diagram showing a control configuration of the ink jet printing apparatus of this embodiment. In the figure, a CPU 700 controls various parts described later and executes data processing. The CPU 700 performs, through a main bus line 705, a head drive control, a carriage drive control and data processing according to programs stored in a ROM 702. The ROM 702 stores a plurality of mask patterns used in a printing operation characteristic of this embodiment, as well as programs. A RAM 701 is used as a work area for data processing by the CPU 700. The CPU 700 also has memories such as hard disks, in addition to the ROM 702 and RAM 701.

An image input unit 703 has an interface with a host device not shown which is connected exteriorly, and temporarily holds an image data supplied from the host device. An image signal processing unit 704 executes data processing, such as color conversion processing and binarization processing.

An operation unit 706 has keys for an operator to enter control inputs.

A recovery system control circuit 707 controls a recovery operation according to a recovery processing program stored in the RAM 701. That is, the recovery system control circuit 707 drives a recovery system motor 708 to operate a cleaning blade 709, a cap 710 and a suction pump 711 for the print head 1102.

A head drive control circuit 715 controls the operation of print element (electrothermal transducers in this embodiment) installed in individual nozzles of the print head 1102 to cause the print head 1102 to execute a preliminary ejection and a printing ejection. Further, a carriage drive control circuit 716 and a paper feed control circuit 717 also control the movement of the carriage and the feeding of paper according to programs.

A substrate of the print head 1102 in which electrothermal transducers are installed is provided with a heater, which heats the ink in the print head to a desired set temperature. A thermistor 712 is similarly provided in the substrate and measures essentially a temperature of the ink in the print head. The thermistor 712 may be installed outside the substrate as long as it is located near the print head.

Figure 7:
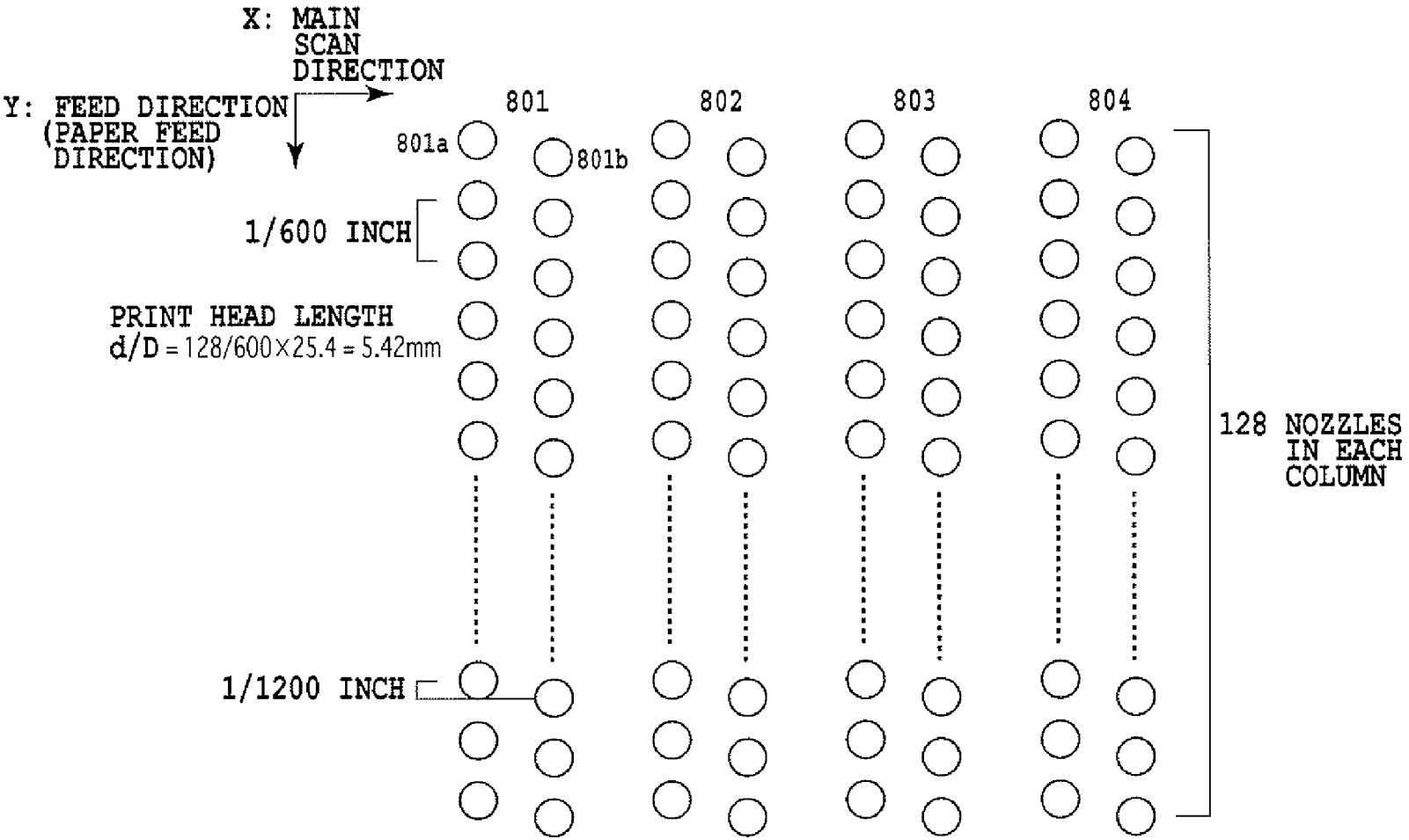
FIG. 7 is a schematic diagram showing arrangements of nozzles in the print head applied to the embodiment of this invention.

FIG. 7 shows an arrangement of ejecting openings (an arrangement of nozzles) in the print head 1102 applied to this embodiment. In the figure, denoted 801 is a nozzle column for a black ink, 802 a nozzle column for a cyan ink, 803 a nozzle column for a magenta ink, and 804 a nozzle column for a yellow ink. These four color ink nozzles each comprise an even nozzle column and an odd nozzle column. In the black ink, for example, 801*a* represents the odd nozzle column and 801*b* represents the even nozzle column. By taking the nozzle column 801 for example, the arrangement of nozzles will be explained in detail.

The odd nozzle column 801*a* and the even nozzle column 801*b* each have 128 nozzles arrayed at 600 dpi, with the odd and even nozzle columns 801*a*, 801*b* staggered in a Y direction (sub scan direction) by 1200 dpi. That is, ejecting ink from the print head as it scans in an X direction (main scan direction) can print a strip of image, about 5.42 mm wide, at a resolution of 1200 dpi in the sub scan direction.

Nozzle columns of other colors also have the similar construction to that of the black nozzle column 801. These four color nozzle columns are arranged side by side in the main scan direction, as shown.

Next, a multi-pass printing method used in the printing apparatus of this embodiment will be explained.

Figure 26:
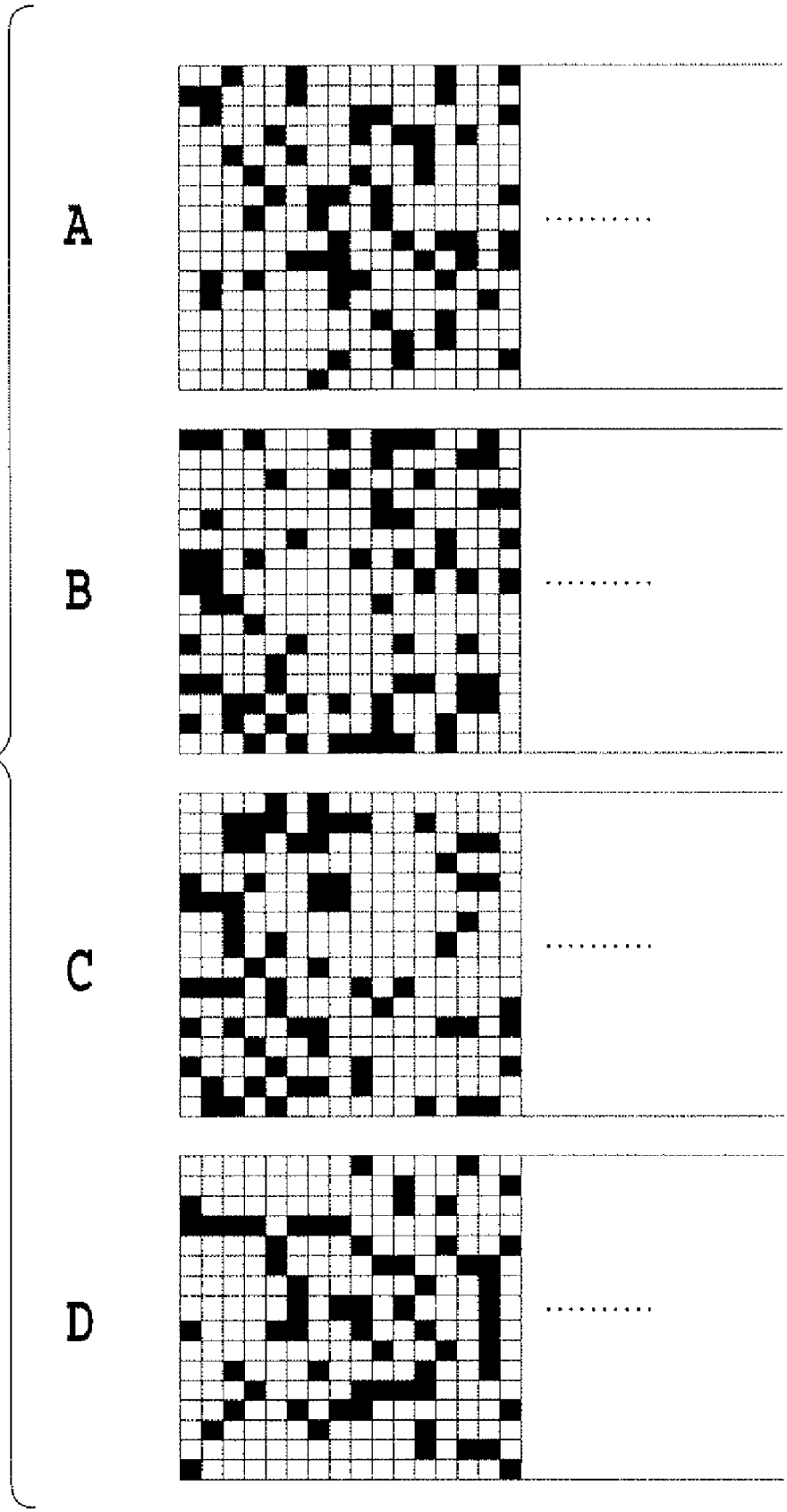
FIG. 26 is a schematic diagram showing examples of random mask patterns applicable to the embodiment.

FIG. 26 is a schematic diagram showing examples of random mask patterns applicable to this embodiment. In the figure, individual squares represent a pixel, a minimum unit area where a dot is to be printed or not to be printed. Black squares represent pixels that permit the printing of an ink dot during the associated printing scan (print permission pixel) and blank squares represent pixels that do not permit the printing of an ink dot during the associated printing scan (print non-permission pixel). A random mask pattern is a mask pattern in which print permission pixels are arranged randomly and non-periodically. A non-periodic mask pattern like this has the characteristics of not synchronizing an image data which has periodicity. Although a mask pattern having a size of 16×16 pixel is used for example, it is preferred that the size in main scan direction is larger. In this embodiment, a mask pattern having a size of 1028 pixel in main scan direction is applied, which is not shown in figure. A random mask pattern can be made by using a method disclosed in Japanese Patent Application No. 3176181.

Four mask patterns for four-pass printing shown in the figure are complementary to one another. In each printing scan, the CPU 700 takes a logical AND of one of mask patterns A-D stored in the ROM 702 and the print data to be print by each nozzle column, thus generating data according to which ink is to be ejected in the associated printing scan.

Figure 8A:
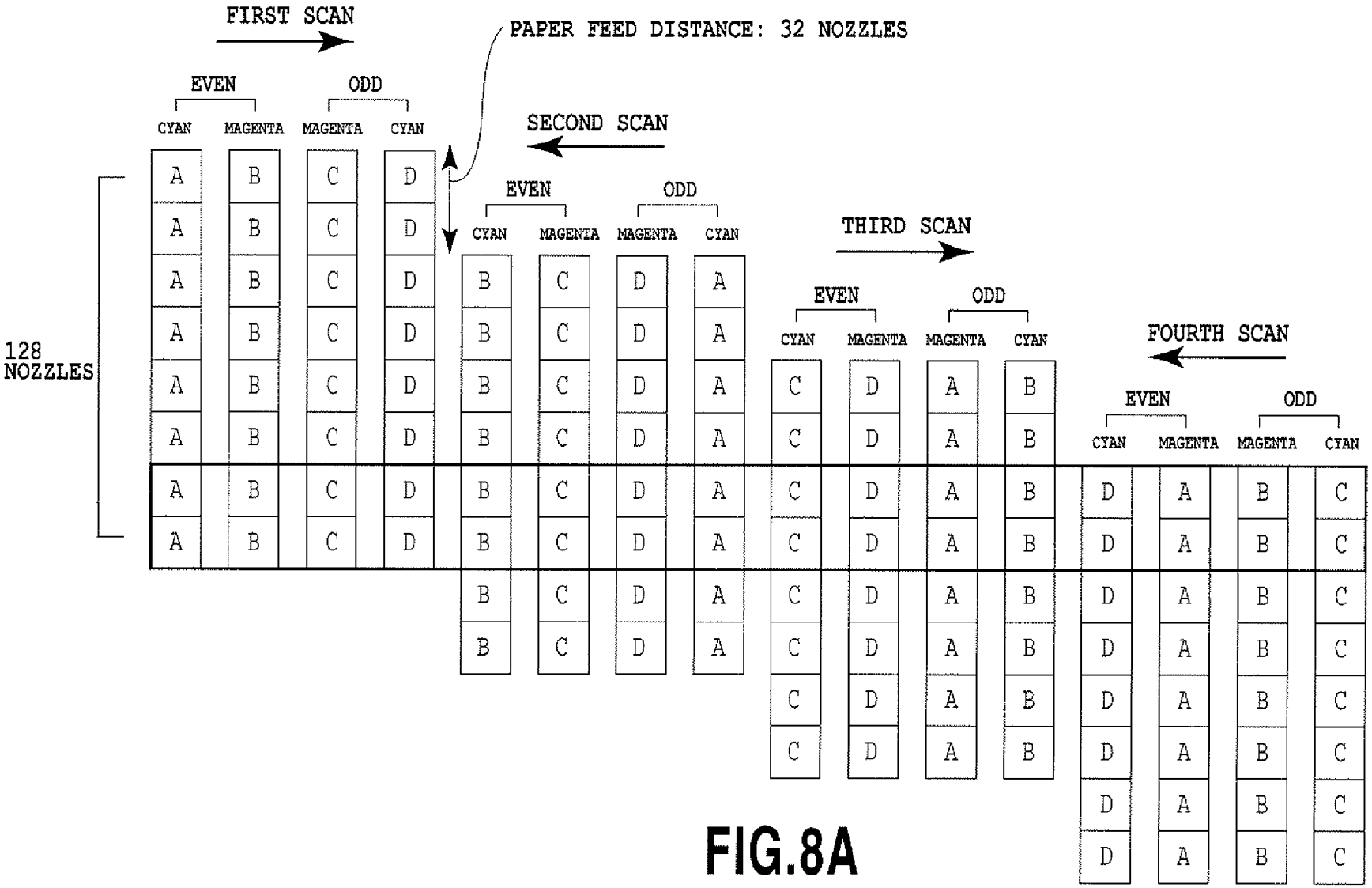
FIGS. 8A and 8B are schematic diagrams showing characteristics of mask patterns applied to the embodiment of this invention.
Figure 8B:
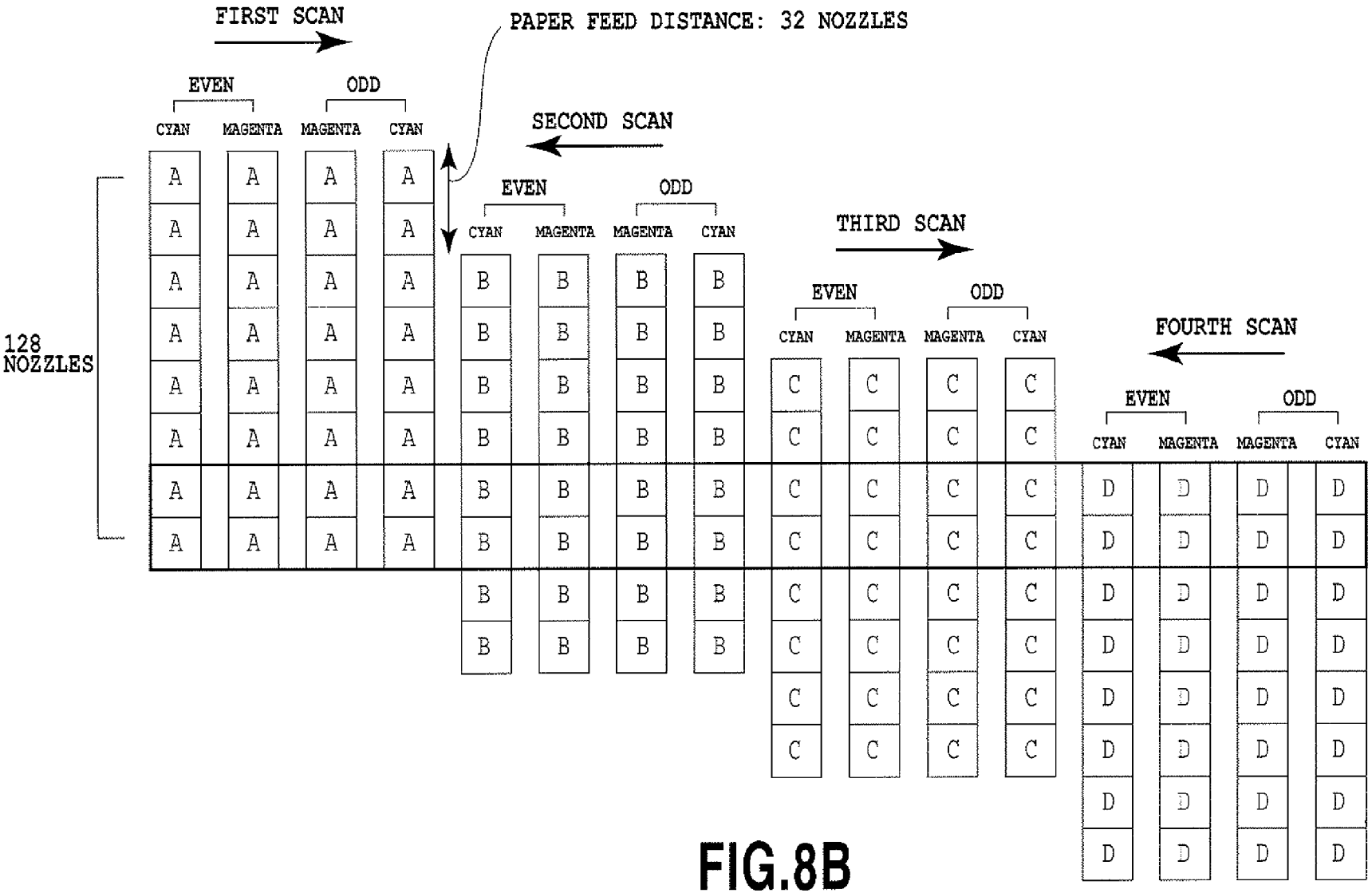

FIGS. 8A and 8B are schematic diagrams showing how the mask patterns A-D are used. Shown here are mask patterns that correspond to the cyan nozzle column 802 and the magenta nozzle column 803 used in a 4-pass bidirectional multi-pass printing. The odd and even nozzle columns, each composed of 128 nozzles, have their nozzles divided into eight blocks of 16 nozzles in the direction of sub scan direction. Each of the blocks is assigned with one of the four mask patterns A-D. In the figure, four printing scans, first to fourth scan, are shown and, between each printing scan, a paper feed operation is done to feed the print medium a distance corresponding to two blocks. Here, the print head is shown to move relative to the print medium.

Reference symbols A-D of FIGS. 8A and 8B correspond to blocks in nozzle columns that apply the mask patterns A-D shown in FIG. 26. They represent four different patterns that are exclusive and complementary to one another. That is, an image to be printed in one and the same image area of a print medium is completed by successively applying one of the four different mask patterns A-D to each of the four main printing scans.

FIG. 8B shows a conventional, commonly used mask pattern arrangement. It is conventionally a common practice to use the same kind of mask pattern in all nozzle columns in the same printing scan, whether the columns are even nozzle columns, odd nozzle columns or different color nozzle columns. That is, in the example shown, during the first scan all nozzle columns use the mask pattern A; during the second scan they use the mask pattern B; during the third scan they use the mask pattern C; and during the fourth scan they use the mask pattern D. In the fifth and subsequent scan, the mask patterns are again used in the same order beginning with A and the main printing scans are repeated with this order of mask patterns maintained.

Figure 5A:
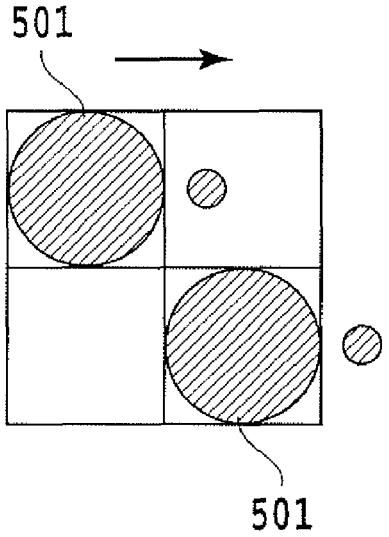
FIGS. 5A to 5C illustrate dot positions when a blue is produced by overlapping cyan and magenta dots.
Figure 5B:
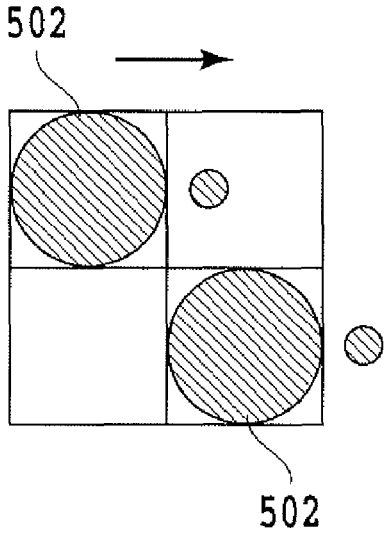

If a blue, a secondary color, is to be produced using such mask patterns, pixels that were printed with cyan dots in one main printing scan are also printed with magenta dots. Thus, dot landing states are as shown in FIG. 5B. That is, cyan ink and magenta ink overlap each other in the printing operation not only for the main dots but also for satellites. The distribution of satellites is deviated with respect to the main dots, making the satellites themselves more conspicuous.

In this embodiment, on the other hand, the mask patterns A-D are distributed as shown in FIG. 8A. In the cyan nozzle columns and magenta nozzle columns, and also in their even nozzle columns and odd nozzle columns, different mask patterns are applied in the same printing scan. For example, in the first scan of the figure, the cyan even nozzle column uses the mask pattern A, the magenta even nozzle column uses the mask pattern B, the magenta odd nozzle column uses the mask pattern C, and the cyan odd nozzle column uses the mask pattern D. In the second scan, these nozzle columns use different mask patterns than those of the first scan. The image data given to the individual nozzle columns are printed by the four main printing scans successively using the mask patterns A-D. It is noted, however, that in two nozzle columns of different colors that print on the same pixels, like cyan even nozzle column and magenta even nozzle column, it is one of the characteristic of this embodiment to use the same mask pattern always in the opposite main scan directions. For example, the mask pattern A used by the cyan even nozzle column during the first scan (forward scan) is used in the fourth scan (backward scan) by the magenta even nozzle column.

Figure 9A:
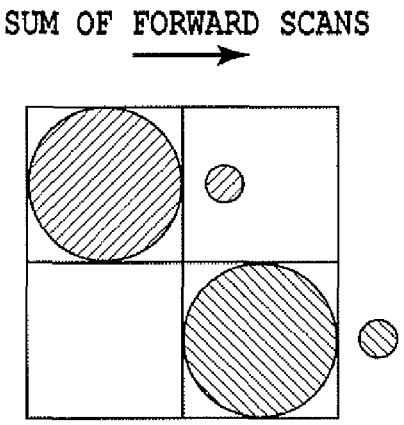
FIGS. 9A to 9C show dot landing states when a blue, a secondary color, is produced by applying the masks of the first embodiment.
Figure 9B:
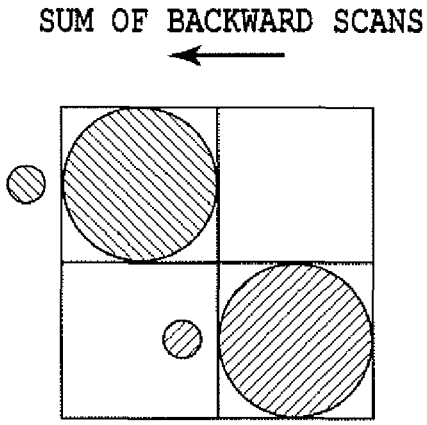
Figure 9C:
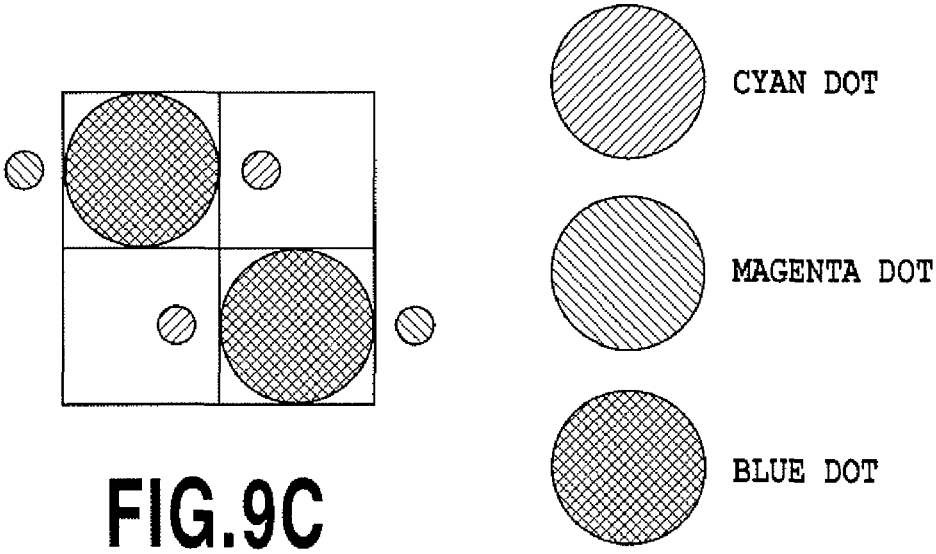

FIGS. 9A to 9C show dot landing states when a blue, a secondary color, is produced by using the masks of this embodiment. FIG. 9A shows a sum of dots printed in the forward scans, i.e., first scan and third scan. Those pixels printed with cyan dots in the forward scan are not printed with magenta dots in the forward scan, and similarly those pixels printed with magenta dots in the forward scan are not printed with cyan dots in the forward scan.

FIG. 9B shows a sum of dots printed in the backward scans, i.e., second scan and fourth scan. In the backward scans, too, those pixels printed with cyan dots are not printed with magenta dots. Similarly, those pixels printed with magenta dots are not printed with cyan dots.

Figure 5C:
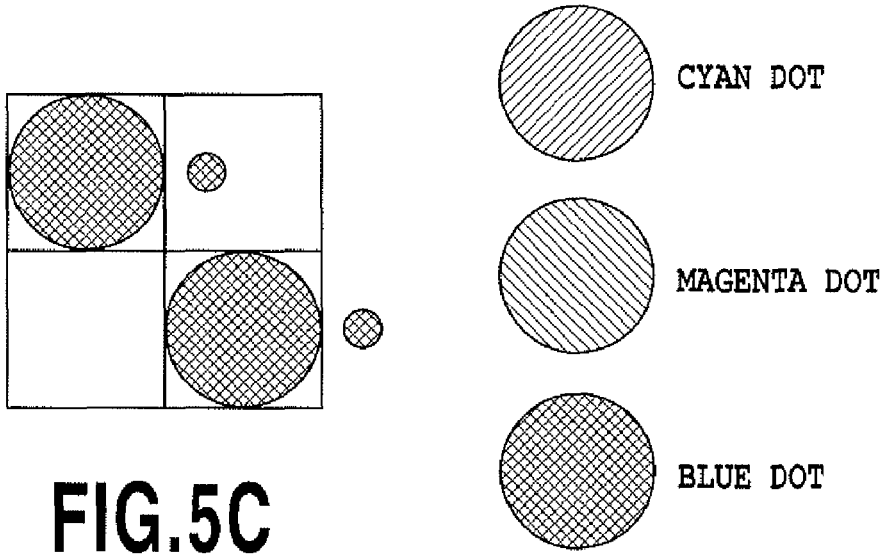

FIG. 9C shows a dot landing state obtained by overlapping the sum of forward scans of FIG. 9A and the sum of backward scans of FIG. 9B. The cyan dots and the magenta dots that land on the same pixels are printed in the scans of opposite directions. Thus, the two satellites of different colors land separately on both sides of a main dot. In this case, satellites are uniformly distributed with respect to main dots. Further, satellites land in blank areas uniformly, thus reducing gaps between dots and granularity caused by gaps and a color difference of dots. Individual satellites of primary color is less noticeable and less granulated than those of secondary color in FIG. 5. Therefore, using dot arrangement of FIG. 9C, a uniform image can be obtained, compared with using dot arrangement of FIG. 5. Further, the dot arrangement that has small satellites located on both sides of the main dots offers an advantage of an easier image design because the center of gravity of dots easily stabilizes at the center of each pixel, when compared with the dot arrangement that has distinctive satellites on only one side of main dots.

Figure 17A:
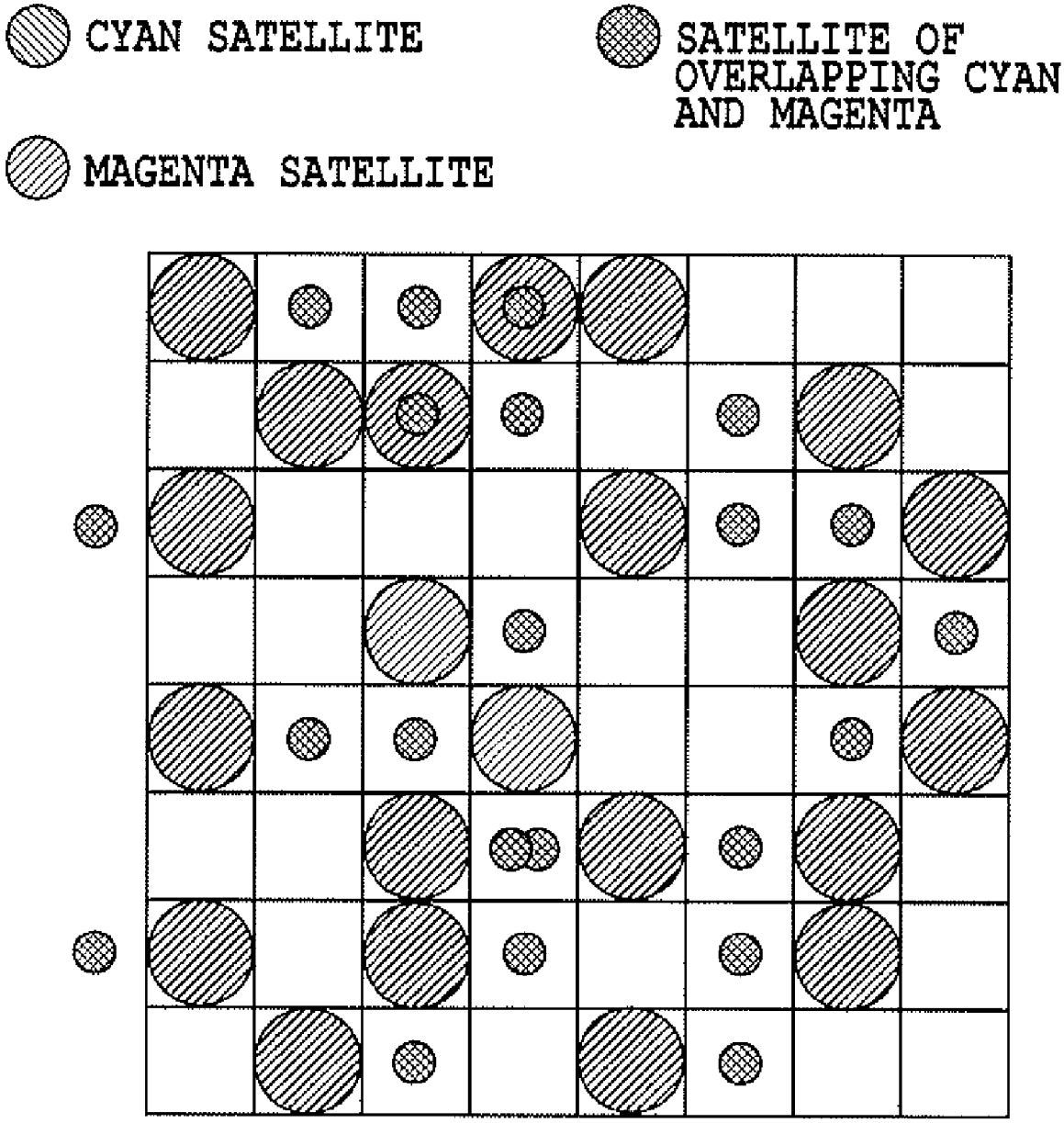
FIGS. 17A and 17B illustrate images in a wider area (8×8 pixels) when a blue, a secondary color, is printed by applying a conventional mask and a mask of the first embodiment.
Figure 17B:
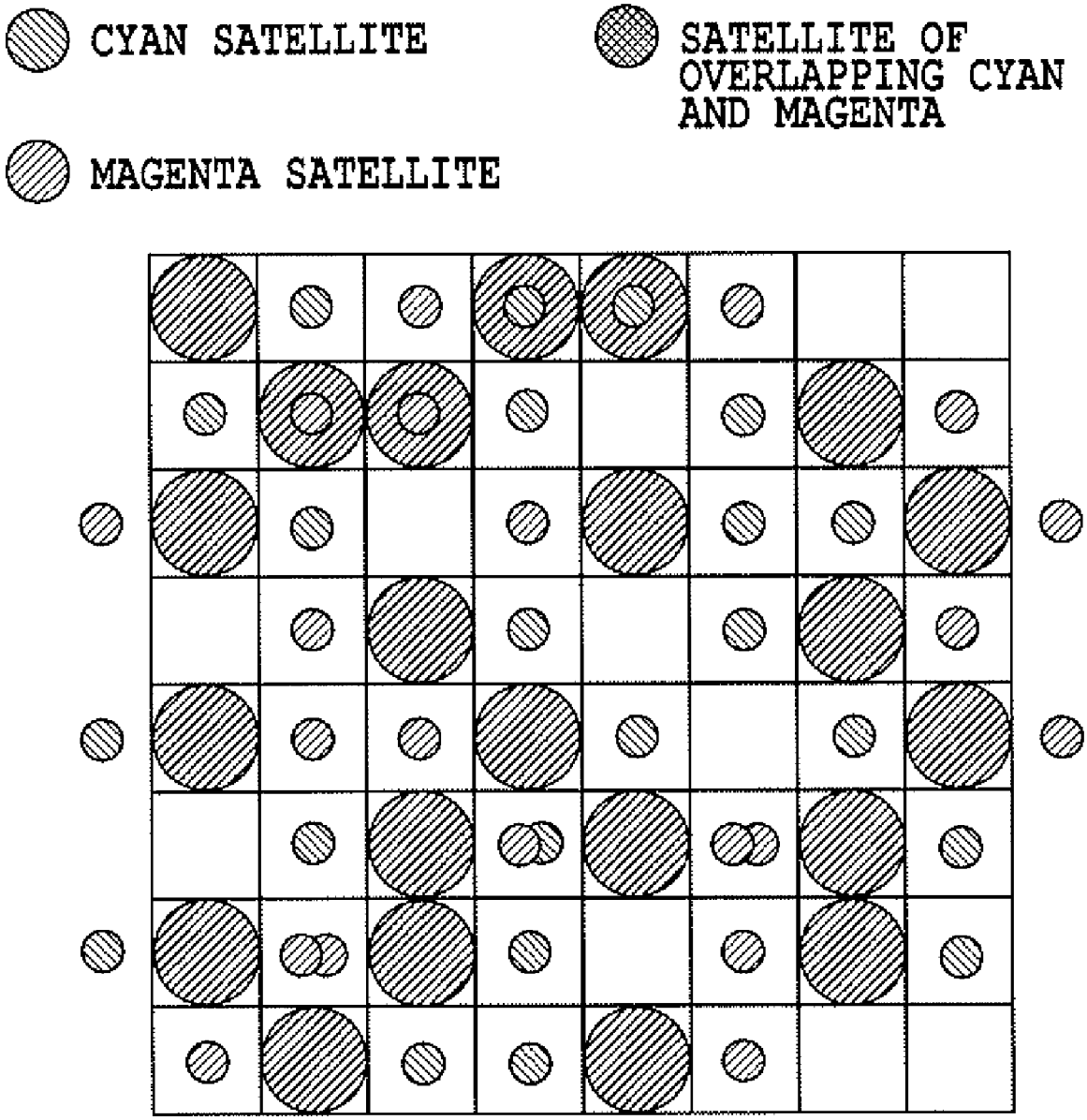

Although FIGS. 9A to 9C show the effects of this invention in terms of individual pixels, FIGS. 17A and 17B show the effects this invention has on images in a wider area. FIG. 17A shows a printed result obtained when cyan dots and magenta dots in the same pixels are printed in the same scan directions by using a conventional mask. FIG. 17B shows a printed result of this embodiment obtained when cyan dots and magenta dots are printed in opposite scan directions. An image in FIG. 17B has satellites distributed more uniformly with respect to main dots than in FIG. 17A, so it has fewer blank areas and a higher level of uniformity.

In the above, the dot position control method has been explained which locates two satellites of different colors on opposite sides of the main droplet, with cyan and magenta taken as an example. In the printing apparatus of this embodiment, however, black and yellow nozzle columns are also mounted in addition to the above two colors, and it is impossible to locate satellites of four colors in all at different positions at all times. It is, however, noted that if color combinations used to produce secondary colors that tend to have higher density and easily show up visually are properly selected and if the above method is employed so that the satellites of the selected color combinations are preferentially arranged in opposite directions, the desirable effects of this embodiment can be fully produced. In the above explanation of the dot position control method, it is decided that cyan and magenta constitutes the above color combination that requires special attention.

Further, while the 4-pass bidirectional printing has been taken for example in the above explanation, the above desired effects can be obtained as long as the multi-pass printing employs two or more passes. If the mask pattern is configured such that, whatever the number of passes, the dots of two colors (cyan and magenta) of interest for the same pixel are printed in different main scan directions, the satellites can be made to land uniformly with respect to the main dots and therefore are evenly dispersed so that they are not easily noticeable, reducing gaps between dots and producing an image of uniform quality. In the printing apparatus of this embodiment, a plurality of print modes may be prepared in advance which, with different number of passes for multi-pass printing, can produce the above effects.

In the above explanation, FIG. 8B has been described to be a conventional, commonly used mask pattern and FIG. 8A a mask pattern of this embodiment. In practice, however, the conventional technique does not necessarily use the same mask pattern for all colors in the same main scan. For example, Japanese Patent Application Laid-open No. 5-278232 discloses a method in which different ink colors use different mask patterns in the same main scan. Further, this document also describes as an example a mask pattern used in a 2-pass bidirectional printing which prints two dots of different colors of interest on the same pixel in different main scan directions. Japanese Patent Application Laid-open No. 5-278232, however, doesn't disclose the arrangement in which satellites of one of two different colors of interest and those of the other color are placed on both sides of the main dots. The reason being that the satellites overlapping with the main dots in the forward or backward scanning don't appear both sides of the main dots. Because the ejection volume at that time is larger than that in current. Accordingly, by the technique of Japanese Patent Application Laid-open No. 5-278232, a printing operation can not perform so that satellites of one color land shifted in the forward direction with respect to the main dots, while the satellites of the other color land shifted in the backward direction with respect to the main dots.

Furthermore Japanese Patent Application Laid-open No. 5-278232, however, describes only fixed mask patterns applicable to relatively narrow areas of, for example, 4×4 pixels. The fixed mask pattern is a mask pattern in which the print permission pixels are arranged periodically.

Figure 10:
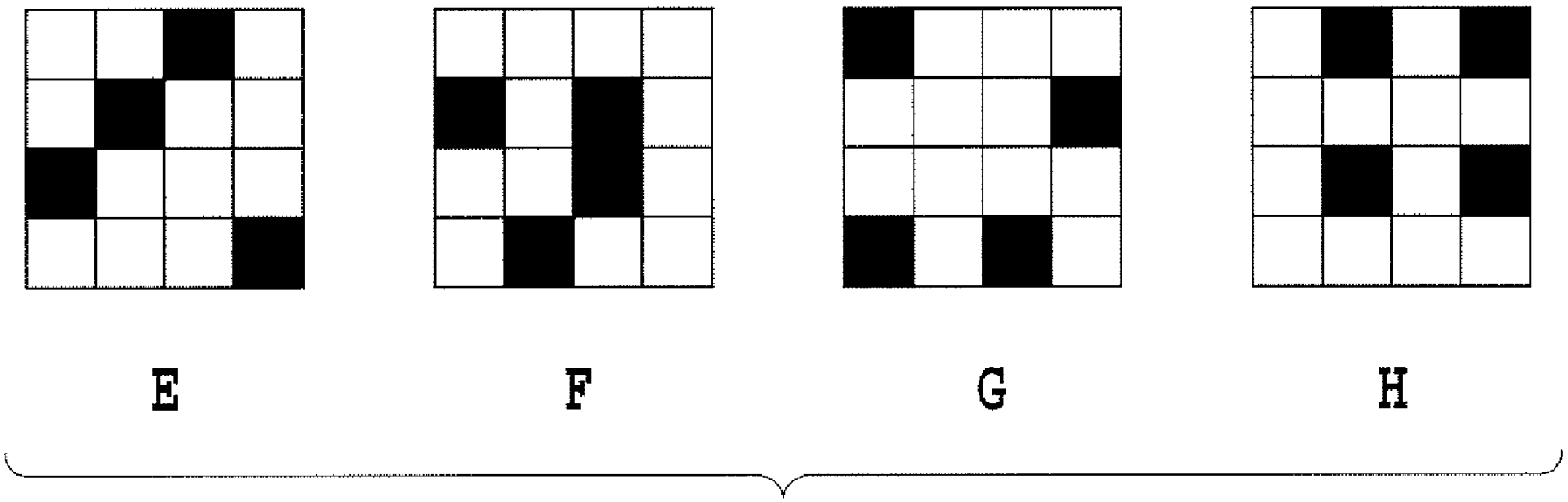
FIG. 10 illustrates examples of fixed mask patterns of 4×4 pixels.

FIG. 10 shows example mask patterns for 4×4 pixels, like those described in Japanese Patent Application Laid-open No. 5-278232. Here, four kinds of mask patterns E-H, complementary to one another, are prepared for a 4-pass multi-pass printing. In the figure, pixels painted black or solid pixels represent pixels that are permitted to be printed (print permission pixel) and blank pixels represent pixels that are not permitted to be printed (print non-permission pixel). In a real printing scan, the narrow-area mask patterns shown in the figure are repetitively arrayed in the main scan direction and sub scan direction for printing.

The embodiment of this invention, on the other hand, applies mask patterns like those shown in FIG. 26 generally called random masks, rather than the fixed mask patterns like those shown in FIG. 10. In the random masks, since print permission pixels are randomly arranged, there is no cyclicity in a relatively wide area. This is a feature of the random masks. Dot landing states will be explained in the following for a case using fixed masks and for a case using random masks.

Figure 11A:
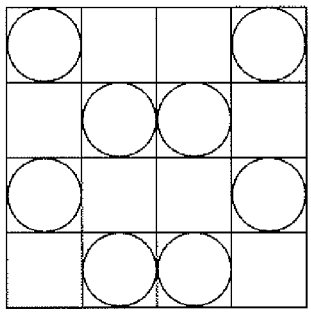
FIGS. 11A to 11C illustrate how a 4-pass bidirectional multi-pass printing is performed by using fixed mask patterns.
Figure 11B:
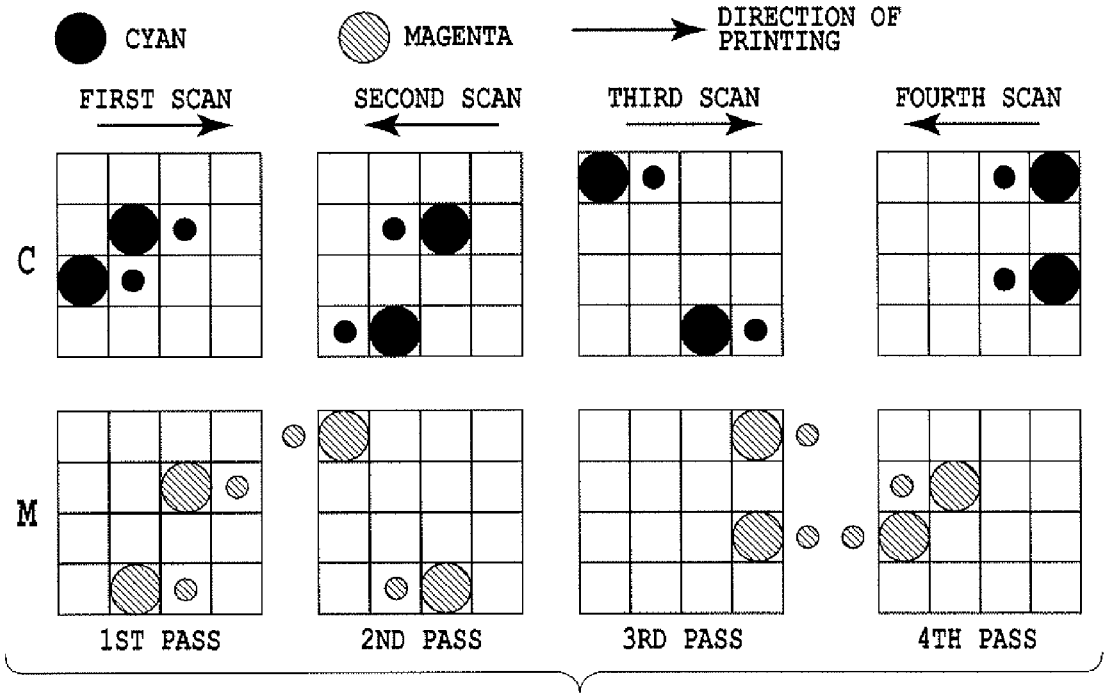
Figure 11C:
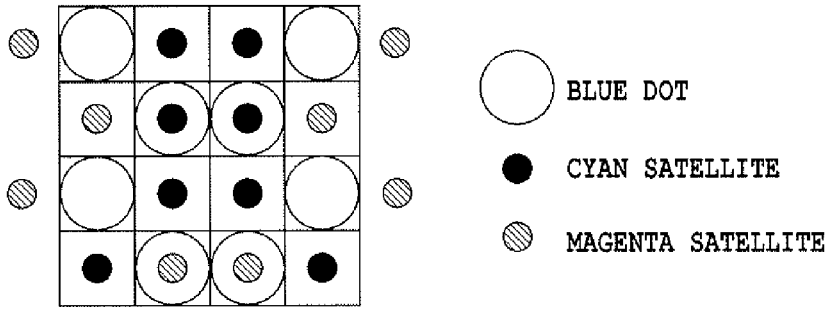

FIGS. 11A-11C show how a 4-pass bidirectional printing is performed using fixed mask patterns of FIG. 10. Here, FIG. 11A represents blue image data to be printed. Pixels with a blank circle are those where a blue dot is to be formed, i.e., a cyan dot and a magenta dot are to be printed overlappingly.

FIG. 11B shows dot landing states in each printing scan when the image data of FIG. 11A is printed using the mask patterns of FIG. 10. Here, the mask patterns are chosen for each printing scan so that the printing on the same pixel is performed in opposite main scan directions for cyan and magenta.

FIG. 11C show a dot arrangement in an image completed by four main printing scans shown in FIG. 11B. Cyan satellites and magenta satellites are separated and arranged on both sides of the main dots.

Figure 12:
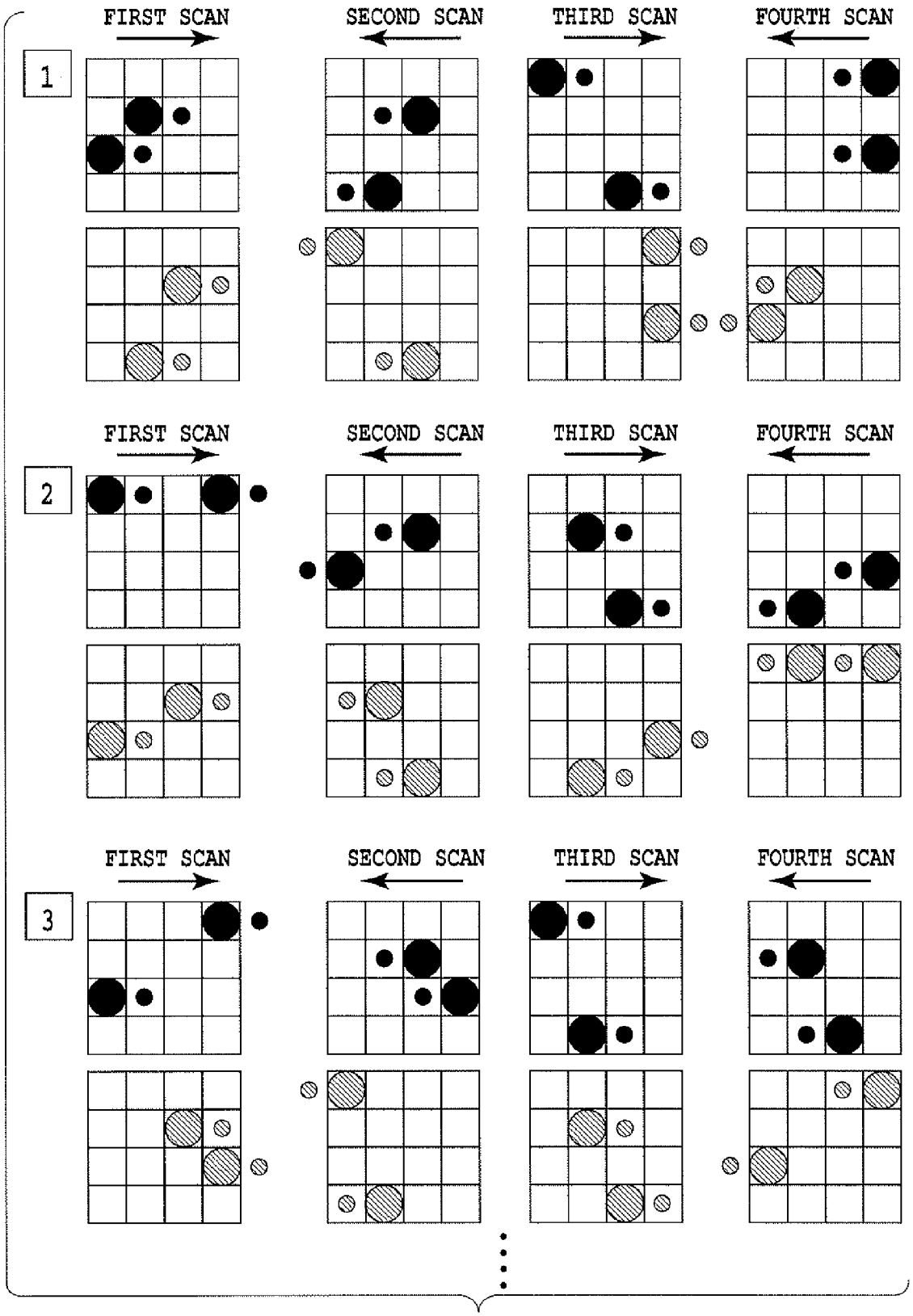
FIG. 12 show dot landing states when image data is printed using random mask patterns.

FIG. 12 show dot landing states in each printing scan when the image data of FIG. 11A is printed using random mask patterns. Here, three 4×4-pixel areas are chosen arbitrarily from within a print area and dot landing states in four printing scans on the area are shown, as in FIG. 11B. Unlike the fixed mask patterns, the random mask patterns applied in this embodiment do not have any regularity such as periodicity. Therefore, the arbitrarily extracted three patterns also have different dot arrangements.

Figure 13:
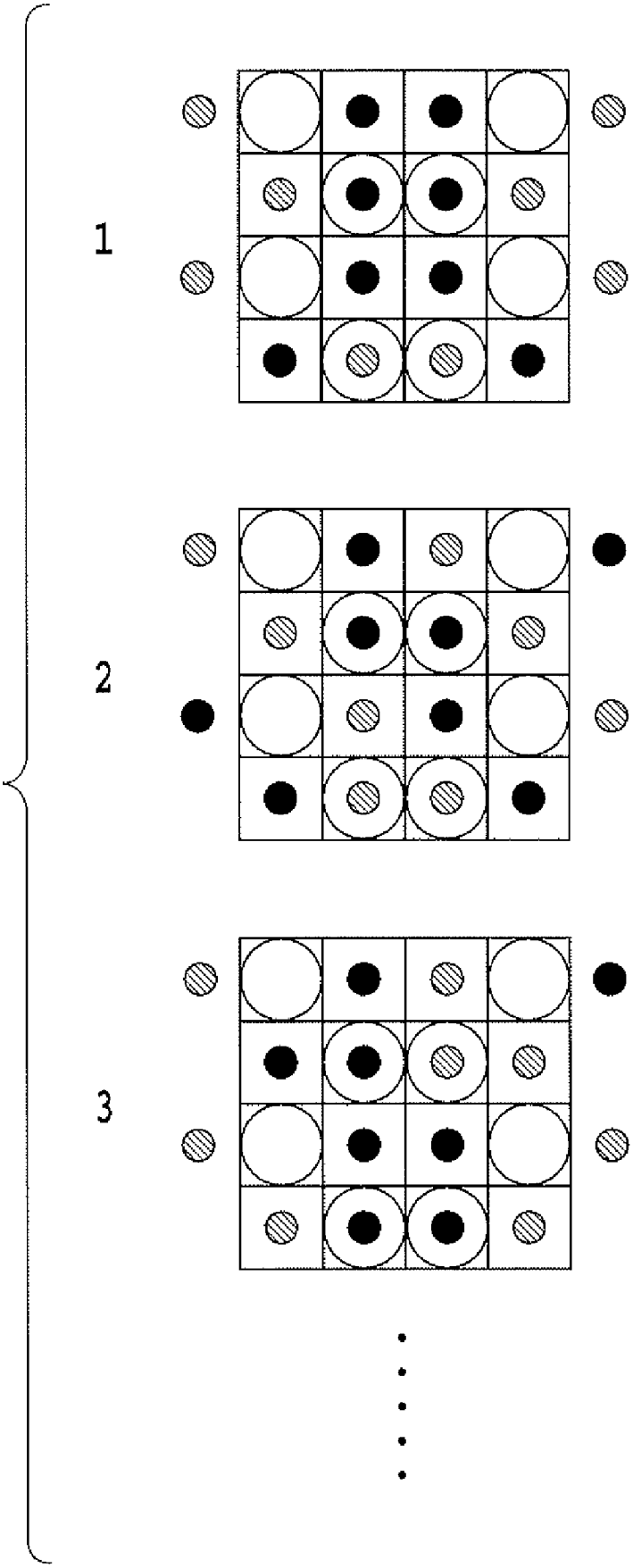
FIG. 13 illustrates dot arrangements of an image completed by four main printing scans.

FIG. 13 shows dot arrangements in an image that is completed by four main printing scans in each of the three areas of FIG. 12. As in FIG. 11C, cyan satellites and magenta satellites are separated and arranged on both sides of the main dots but their positions differ among the three areas.

Figure 14A:
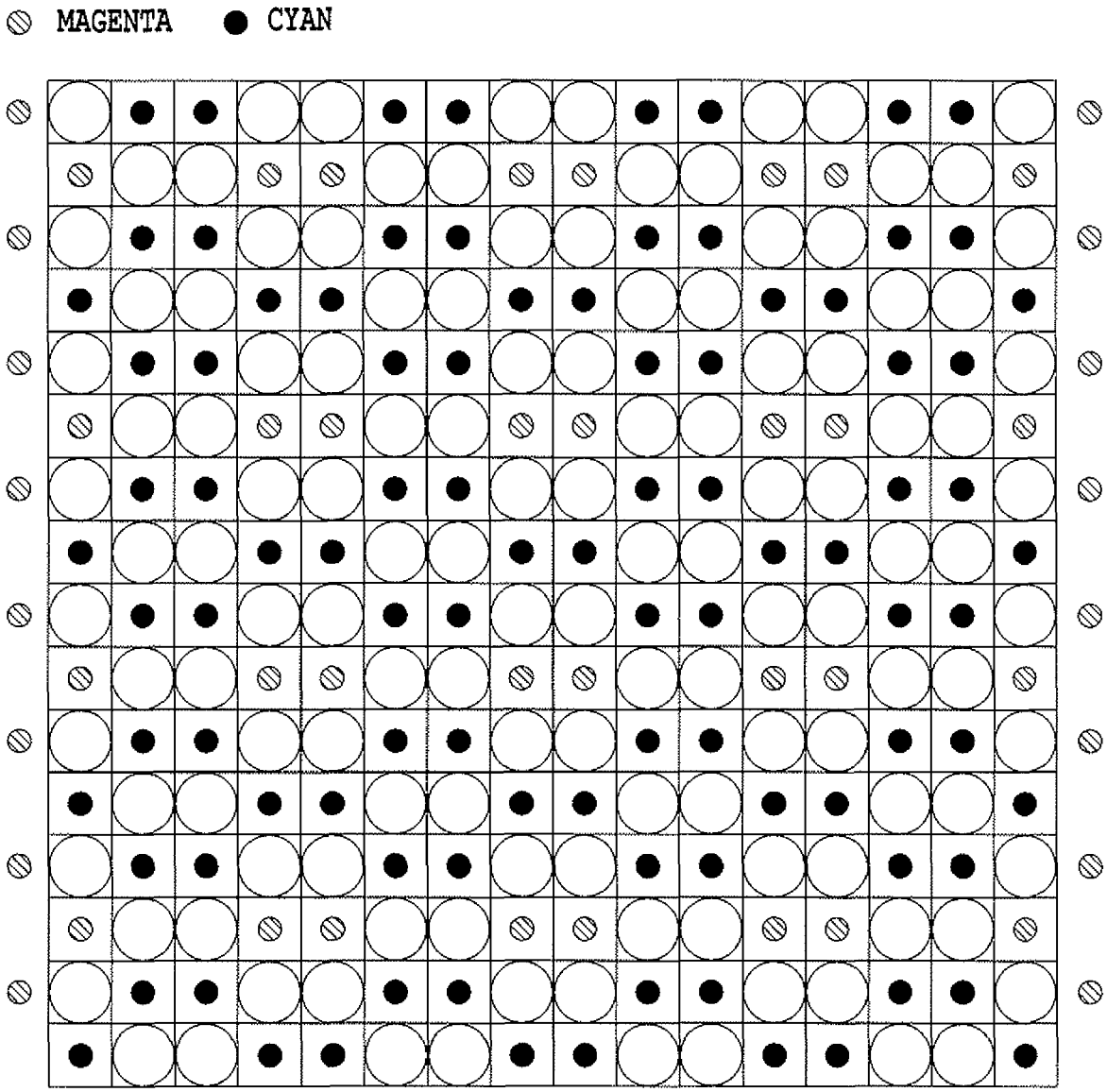
FIGS. 14A and 14B illustrate images completed in a wider area (16×16 pixels) using a fixed mask and a random mask.
Figure 14B:
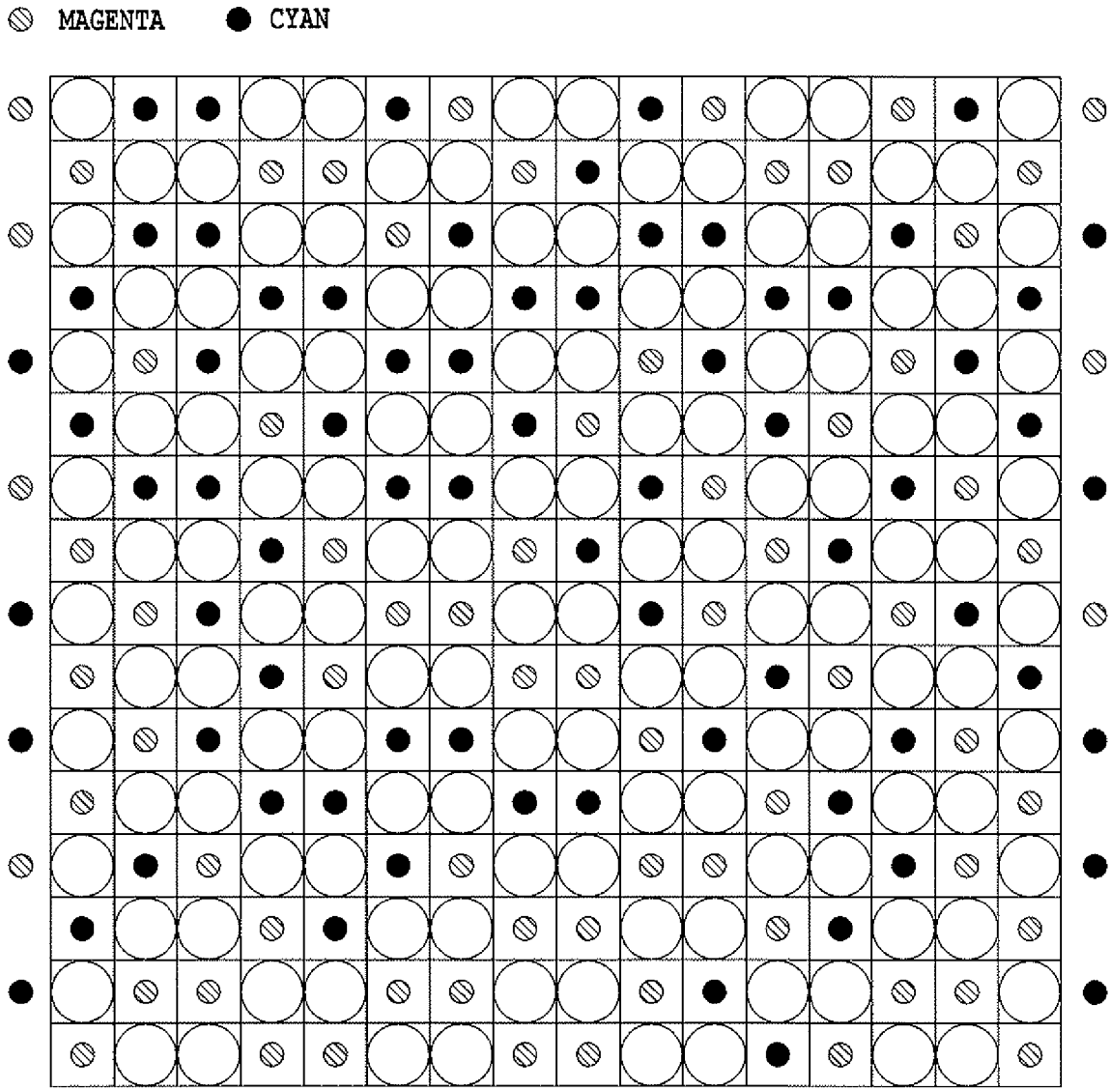

FIGS. 14A and 14B show images in a wider area (16×16 pixels) that are completed by using the fixed mask and the random mask, respectively. Here, satellites that have landed on main dots are not shown. Since the blue main dots are formed by a cyan dot and a magenta dot overlapping one another, if satellites land on these main dots, the color of the main dots is not greatly affected by the satellites. On the other hand, satellites that have landed on blank areas have considerable effects on the color of the image area of interest. Thus, let us consider those satellites that land on white areas.

With the above situations considered, let us refer to FIG. 14A. It is seen that there are far more cyan satellites than magenta satellites. That is, in the case of FIG. 14A, the color of the area of interest (16×16 pixels) is slightly shifted toward cyan from the normal blue.

The mask pattern with a fixed regularity, such as shown in FIG. 11B, easily tunes with regular image data like that of FIG. 11A. Hereby, the dot arrangement of FIG. 11C that is determined by the relation between the image data and the mask pattern appears repetitively in the main scan direction and the sub scan direction. Therefore, the color deviation that occurs in a narrow area, such as shown in FIG. 11C, is maintained in all areas, affecting the entire image. Although we have take up the pattern of FIG. 11A for example, if a fixed mask pattern is used, the above phenomenon can occur even with other image data. Particularly when a binarization method with some regularity is adopted, as in the case with a dither pattern, the color may shift toward cyan or magenta and become very unstable depending on the kind of dither pattern and its grayscale level.

In contrast to the above, in FIG. 14B showing the dot arrangement obtained through a random mask, the cyan satellites and the magenta satellites are almost equal in number. That is, in the case of FIG. 14B, the color of the area can be said to be almost identical with the normal blue. When a random mask is used, the mask pattern does not tune with image data whatever image data is entered. Thus, the number of cyan satellites is kept almost equal to that of magenta satellites, with the result that the color in an even wider area will not shift greatly from the normal blue.

For the reasons described above, it is desired that a mask pattern with no cyclicity, such as random masks, be used in order to produce the desired effect of this embodiment. This is because the use of a fixed mask pattern, such as described in Japanese Patent Application Laid-open No. 5-278232, results in a color shift due to the tuning between image data and mask pattern, reducing an effect for uniformity of multi-pass printing compared with use of a random mask pattern. However, it is able to obtain an effect of this invention even if using the fixed mask pattern. Therefore this invention doesn't exclude the use of the fixed mask pattern having periodicity.

This embodiment has been described to use different mask patterns A-D in a predetermined order in different printing scans both for cyan ink and for magenta ink during the 4-pass bidirectional printing. The present invention is not limited to this configuration. Where there are a plurality of forward scans and backward scans, the four mask patterns are acceptable even if they don't have the same configuration as long as the sum of the cyan mask patterns in the forward scans and the sum of the magenta mask patterns in the backward scans agree.

As described above, a satellite of a first ink lands shifted in the forward or backward direction with respect to main dots of the first and second ink and a satellite of a second ink lands shifted, with respect to the main dots of the first and second ink, in a direction opposite the direction in which the satellite of the first ink shifts. This makes it possible to produce a uniform image.

Second Embodiment

Now, the second embodiment of this invention will be described. In this embodiment, too, the printing apparatus explained in FIG. 1 and FIG. 6 is applied.

Figure 15:
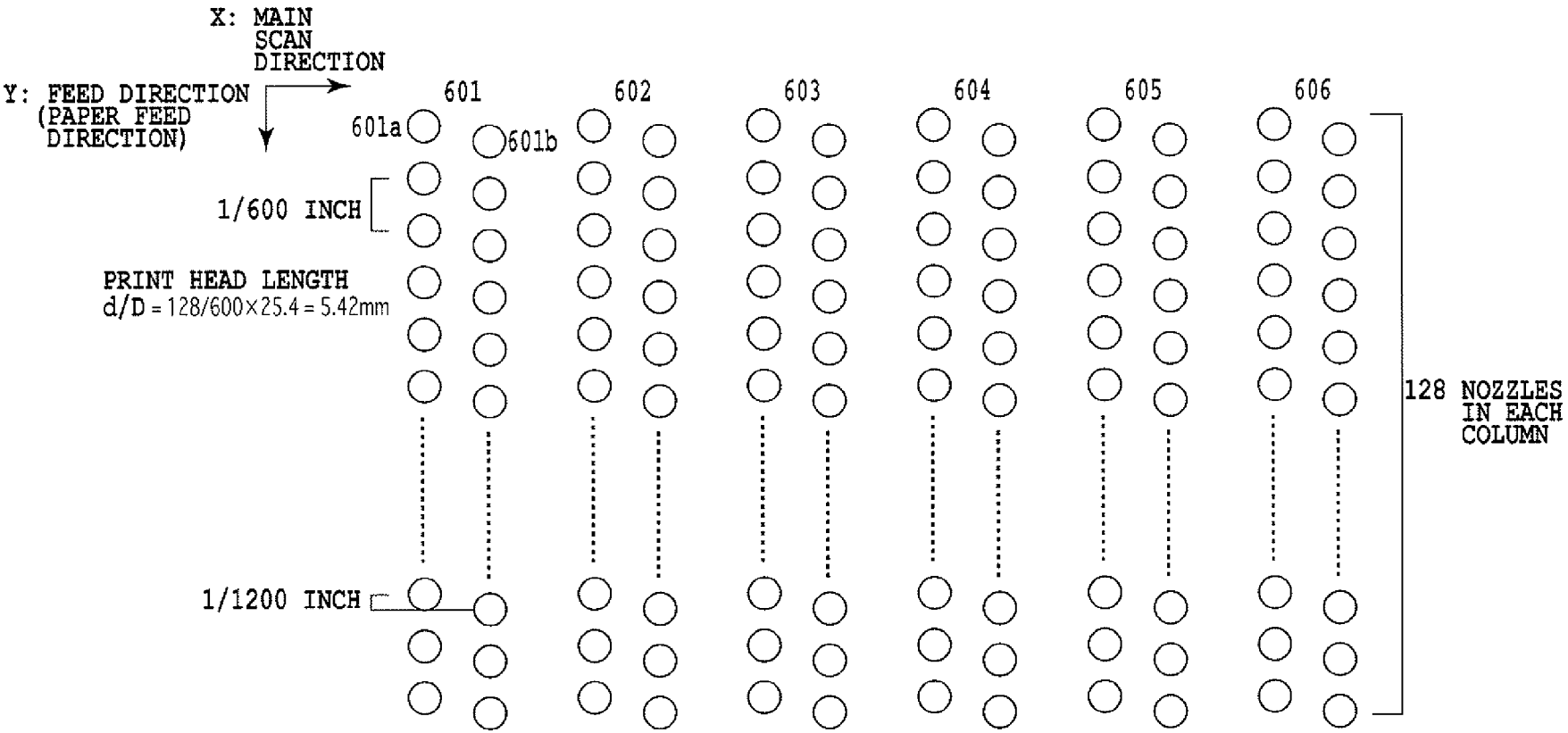
FIG. 15 is a schematic diagram showing arrangements of nozzles in the print head applied to the embodiment of this invention.

FIG. 15 shows nozzle arrangements in the print head 1102 applied to this embodiment. This embodiment employs a total of six colors, including a light cyan ink and a light magenta ink with a low dye or pigment density in addition to the basic four color inks used in the first embodiment. In the figure, denoted 601 is a black ink nozzle column, 602 a cyan ink nozzle column, 603 a light cyan ink nozzle column, 604 a magenta ink nozzle column, 605 a light magenta ink nozzle column, and 606 a yellow ink nozzle column. These nozzle columns of six colors are each comprised of an even nozzle column and an odd nozzle column, as in the first embodiment.

Figure 16:
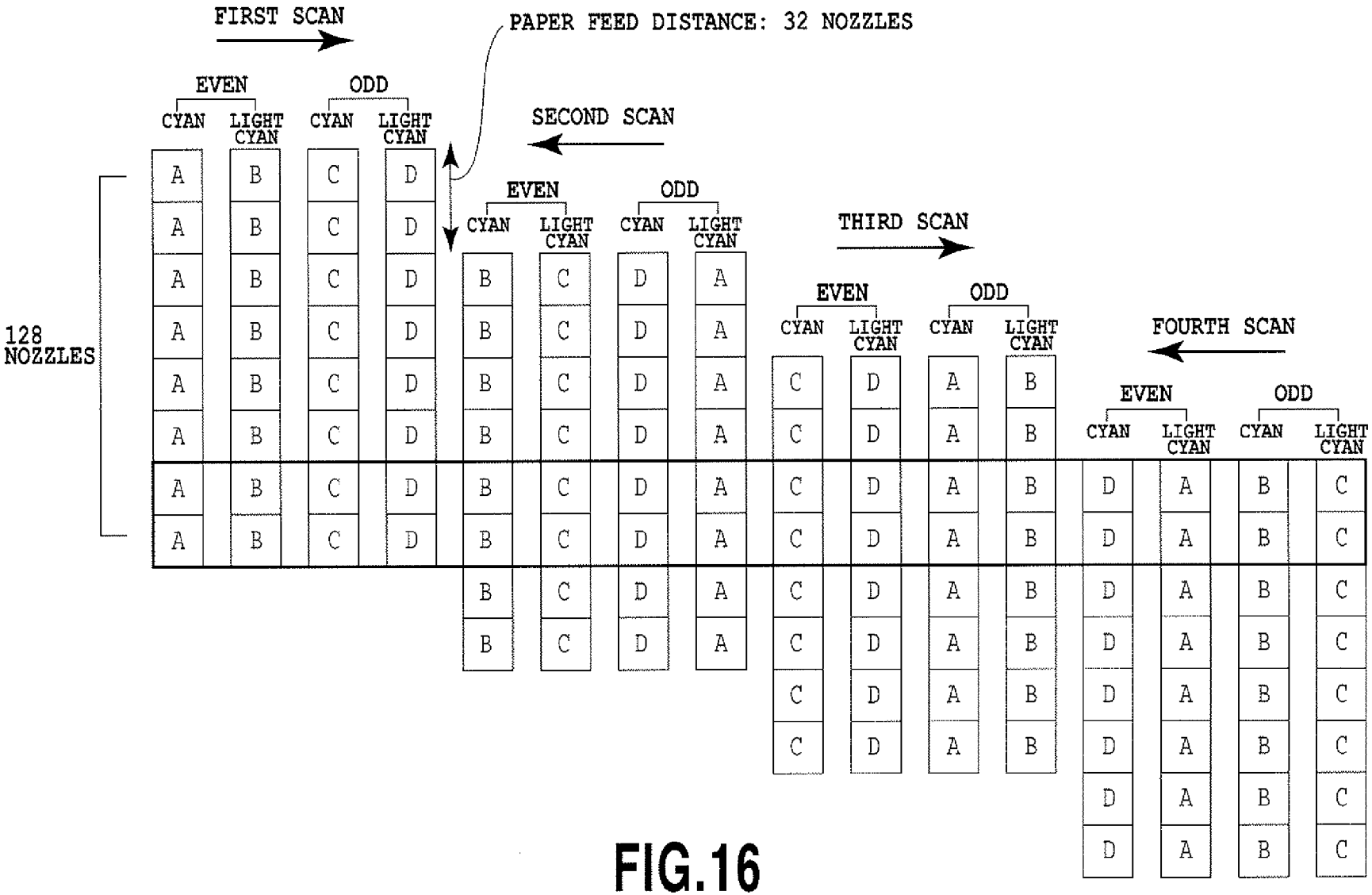
FIG. 16 is a schematic diagram showing mask patterns applied to the embodiment of this invention.

FIG. 16 schematically illustrates mask patterns applied to this embodiment. Shown here are mask patterns for the cyan nozzle column 602 and for the light cyan nozzle column 603 in a 4-pass bidirectional multi-pass printing. The odd and even nozzle columns, each composed of 128 nozzles, have their nozzles divided into eight blocks of 16 nozzles in the sub scan direction, to each of which one mask pattern is applied. FIG. 16 shows four printing scans, first to fourth scan, and between each printing scan the print medium is fed a distance corresponding to two blocks. Here, the print head is shown to move relative to the print medium.

In the FIG. 16, reference symbols A-D represent four different mask patterns that are exclusive and complementary to one another. That is, image to be printed on one image area on the print medium is completed by successively applying one of the four different mask patterns A-D to each of the four main printing scans. In this embodiment, too, the individual mask patterns A-D are random masks with no periodicity.

In the cyan nozzle columns and light cyan nozzle columns and also in the even nozzle columns and odd nozzle columns, this embodiment applies different mask patterns in the same printing scans. For example, in the first printing scan, the cyan even nozzle column uses a mask pattern A, the light cyan even nozzle column uses a mask pattern B, the cyan odd nozzle column uses a mask pattern C, and the light cyan odd nozzle column uses a mask pattern D. In the second scan, these nozzle columns use different mask patterns than those of the first scan. The image data given to the individual nozzle columns are completely printed by the four main printing scans successively using the mask patterns A-D. It is noted, however, that in two nozzle columns ejecting different ink in concentration onto the same pixels, like cyan even nozzle column and light cyan even nozzle column, the same mask pattern is used always in the opposite main scan directions.

When such mask patterns are employed, pixels that are printed with cyan dots in the forward printing scans are not printed with light cyan dots in the same scan. Similarly, pixels that are printed with light cyan dots are not printed with cyan dots in the same scan. Therefore, cyan satellites and light cyan satellites are separated and placed on both sides of the main dots.

Even with a combination of inks having similar hue (similar color inks), such as cyan dots and light cyan dots, two satellites when they overlap each other can have greater effects on an image. Therefore, keeping the two kinds of satellites as much isolated as possible, as in this embodiment, is effective in keeping a high level of image quality. Further, as in the first embodiment, the dot arrangement that puts small satellites on both sides of the main dots offers an advantage that the center of gravity of dots easily stabilizes at the center of each pixel, facilitating an image design, compared with the dot arrangement that puts distinctive satellites on only one side of the main dots.

In the above, we have described the dot position control method that puts the satellites of two different colors, e.g., cyan and light cyan, on opposite sides of the main dots. It is possible that the printing apparatus of this embodiment applies the mask patterns that establish the above relationship also between magenta and light magenta.

In the above two embodiments, explanations have been given to the combination of cyan and magenta or of cyan and light cyan. The present invention of course is applicable to other combinations. For example, the present invention can effectively function in such combinations as cyan and light magenta, and light cyan and light magenta, as long as problems are caused by satellites of different colors of above combination overlapping each other. Further, this invention can also be applied to a printing apparatus that represents the density of one pixel by using two different ejection amounts of ink droplets which have the same ink color and the same colorant concentration.

Third Embodiment

Now, the third embodiment of this invention will be described. In this embodiment, too, the printing apparatus explained in FIG. 1 and FIG. 6 is applied.

Figure 18:
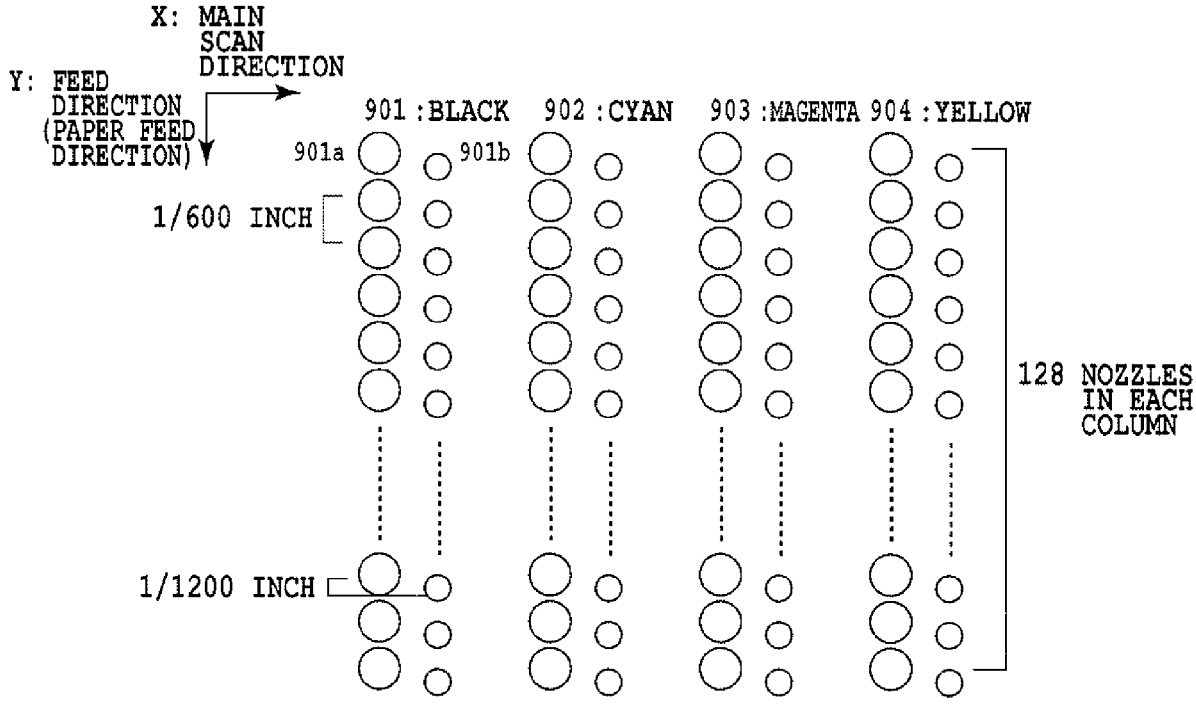
FIG. 18 is a schematic diagram showing arrangements of nozzles in a print head applied to a third embodiment of this invention.

FIG. 18 shows nozzle arrangements in the print head 1102 applied to this embodiment. This embodiment replaces a part of the nozzle columns used in the first embodiment with nozzle columns having different opening diameters. In the figure, denoted 901 is a black ink nozzle column, 902 a cyan ink nozzle column, 903 a magenta ink nozzle column, and 904 a yellow ink nozzle column. Unlike the first embodiment, the even nozzle column and the odd nozzle column are composed of nozzles of different sizes. For convenience, dots ejected from the odd nozzle column 901*a* are defined to be large dots and dots ejected from the even nozzle column 901*b* small dots.

Figure 19:
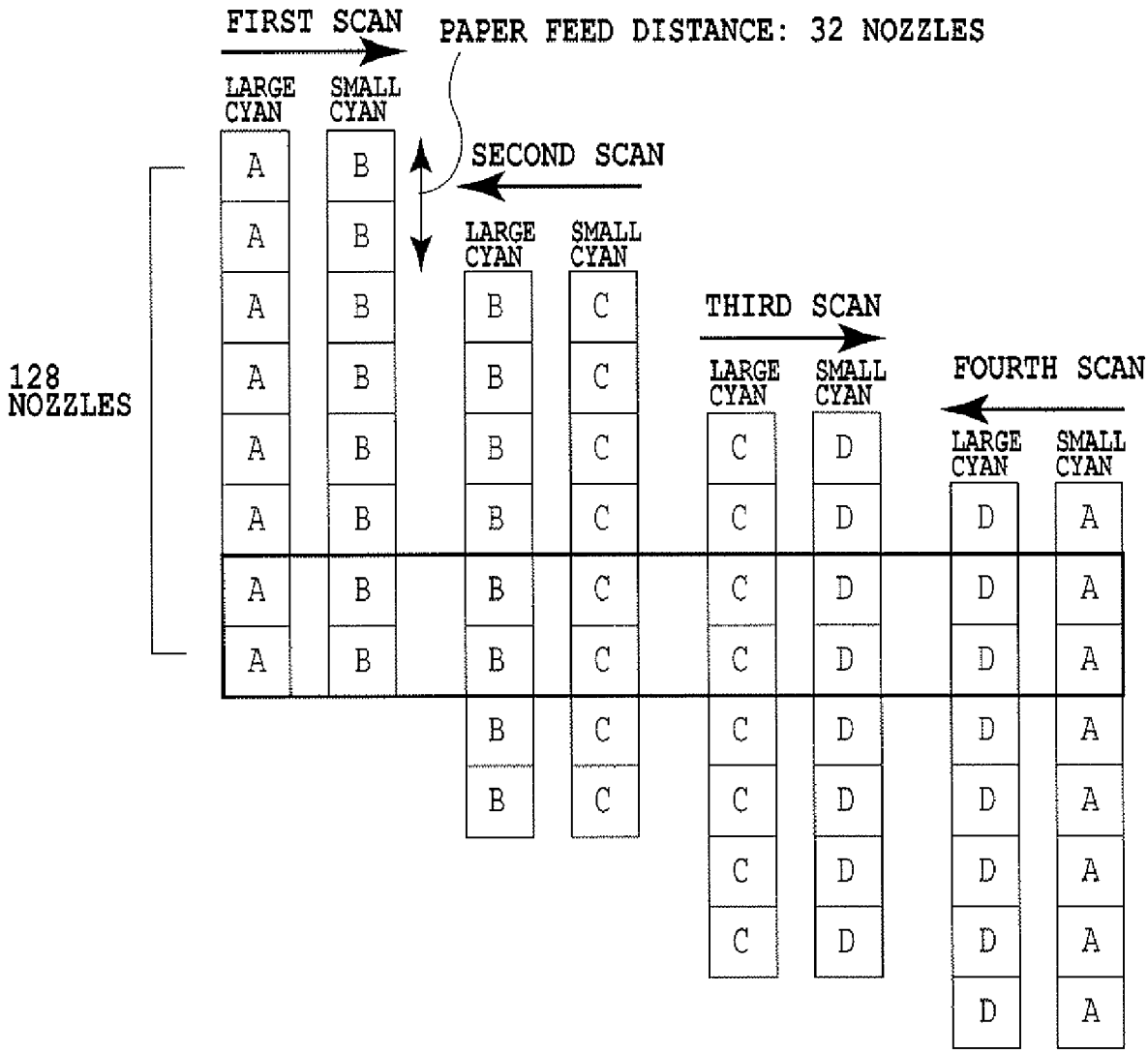
FIG. 19 is a schematic diagram showing mask patterns applied to the third embodiment.

FIG. 19 is a schematic diagram showing a mask pattern arrangement applied in this embodiment. Here are shown mask patterns corresponding to the large cyan nozzle column 901*a* and the small cyan nozzle column 901*b* of the cyan nozzle column 901 used in a 4-pass bidirectional multi-pass printing. The odd and even nozzle columns, each composed of 128 nozzles, have their nozzles divided into eight blocks of 16 nozzles in the sub scan direction, to each of which one mask pattern is applied. FIG. 19 shows four printing scans, first to fourth scan, and between each printing scan the print medium is fed a distance corresponding to two blocks. Here, the print head is shown to move relative to the print medium.

In the figure, reference symbols A-D represent four different mask patterns that are exclusive and complementary to one another. That is, image to be printed on one image area on the print medium is completed by successively applying one of the four different mask patterns A-D to each of the four main printing scans. In this embodiment, too, the individual mask patterns A-D are random masks with no periodicity.

In the large cyan nozzle column and the small cyan nozzle column, this embodiment uses different mask patterns in the same printing scan. For example, in the first scan of FIG. 19, the large cyan nozzle column uses a mask pattern A, and the small cyan nozzle column uses a mask pattern B. In the second scan, these nozzle columns use different mask patterns than those of the first scan. The image data given to the individual nozzle columns are completely printed by the four main printing scans successively using the mask patterns A-D. It is noted, however, that in two nozzle columns of large and small nozzles, the same mask pattern is used always in the opposite main scan directions.

If, in an area consists of one pixel in the main scan direction and two pixels in the sub scan direction (one pixel represents a lattice of 1200×1200 dpi), a large cyan dot is printed in the first pixel and a small cyan dot in the second pixel using the same mask for each column, these adjoining pixels are printed in the same scan direction. To prevent this, the above mask pattern is used in a way that causes the large dot and small dot that are supposed to be formed in the adjoining pixels of the 1×2-pixel area to be printed in different scan directions.

Figure 20A:
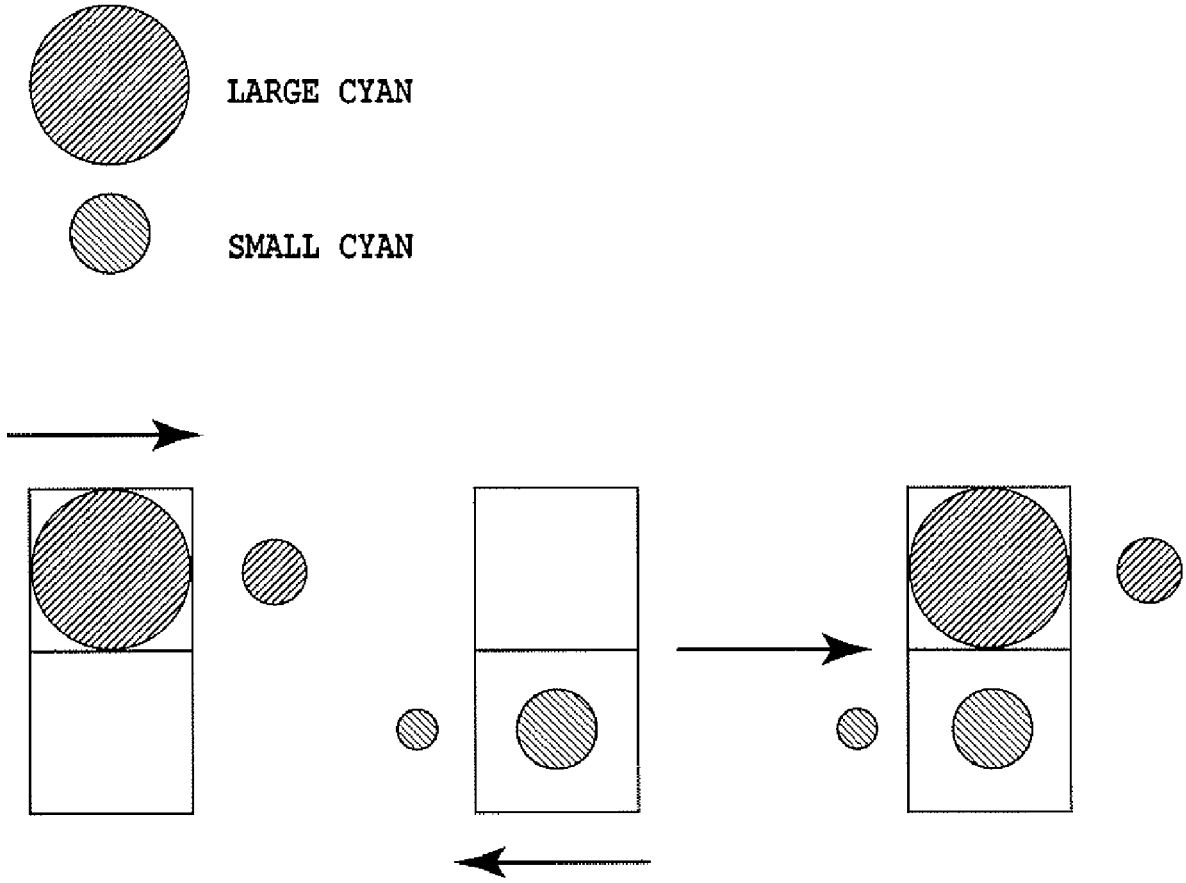
FIGS. 20A and 20B illustrate dot landing states when large dots and small dots are printed on pixels that adjoin each other in the nozzle arrangement direction, by applying the mask of the third embodiment.

When such a mask pattern as described above is employed, satellites of large dot and satellites of small dot are almost uniformly scattered to the left and right of the main dots, as shown in FIG. 20A, with the large cyan dot and small cyan dot as the main dots being arrayed in the sub scan direction in the 1×2-pixel area. As a result, a uniform image can be obtained.

Figure 20B:
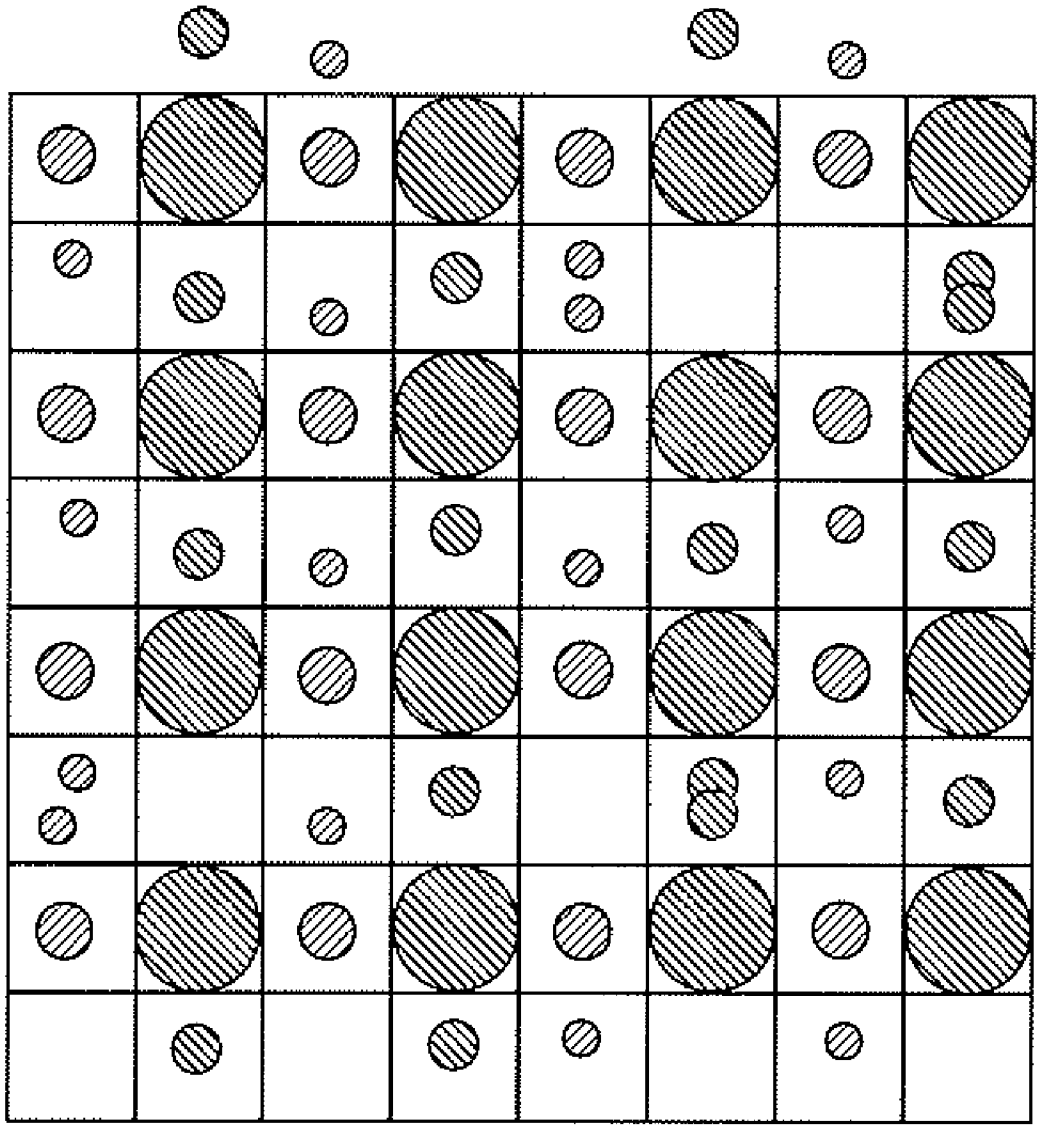
Figure 21A:
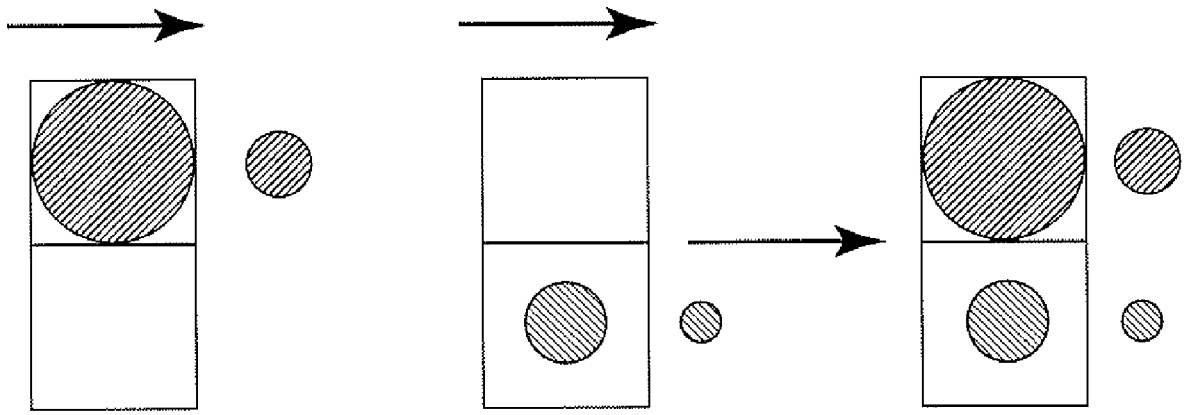
FIGS. 21A and 21B illustrate dot landing states when large dots and small dots are printed on pixels that adjoin each other in the nozzle arrangement direction, by applying a conventional mask.
Figure 21B:
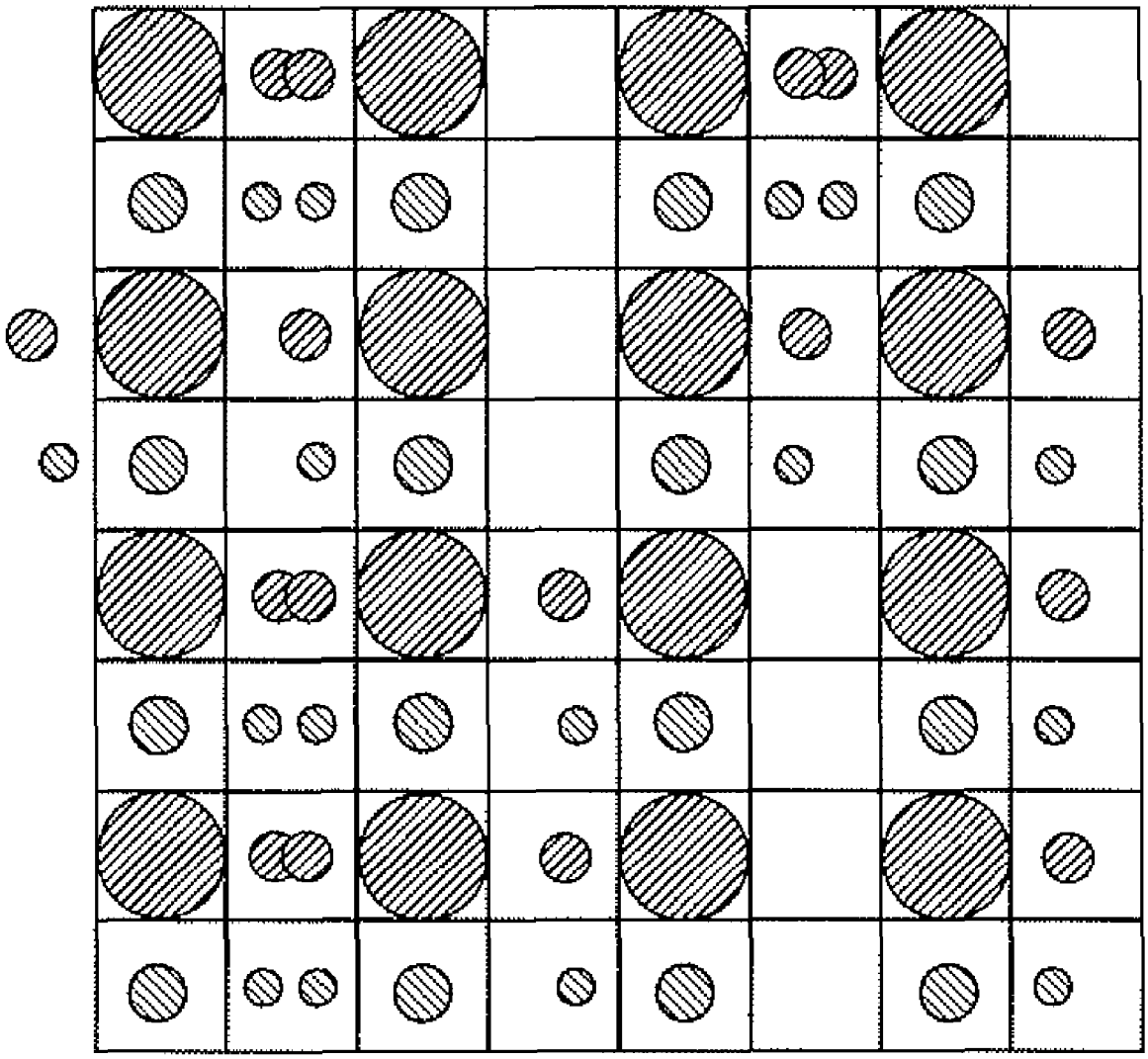

FIG. 20B shows a printed state in a wider area as realized by this embodiment. Satellites that land unevenly to the left and right of the main dots as viewed from the nozzle column direction have considerable adverse effects on the image even if the satellites and main dots are of the same color. FIG. 21A shows a dot landing state when the same mask is applied to the large dot column and the small dot column in the same scan. When a 1×2-pixel area is considered, since the adjoining pixels are always printed in the same scan direction, satellites land on the same side of the main dots. FIG. 21B shows a dot landing state in a wider area. Compared with FIG. 20B, blank areas and satellite overlapping areas show up more distinctly, indicating that the satellite distribution is uneven. Therefore, keeping the two kinds of satellites of the main dots that are printed in adjoining pixels in the nozzle column direction (perpendicular to main scan direction; that is conveying direction) as much isolated as possible, as in this embodiment, is effective in maintaining a high level of image quality. Further, the dot arrangement that puts small satellites on both sides of the main dots of the adjoining pixels, as in the first embodiment, offers an advantage that the dot gravity center easily stabilizes at the center of the pixels, facilitating the image design, when compared with the dot arrangement that places distinctive satellites on only one side of the main dots.

The feature of this embodiment is that, when dots of the same color but of different sizes are printed from two nozzle columns onto two pixels adjoining in the nozzle column direction (perpendicular to main scan direction), rather than onto one and the same pixel, satellites of two different main dots land on opposite sides of the associated main dots. In other words, a satellite of the first main dot lands on that side of the first main dot which is opposite a side of the second main dot where a satellite of the second main dot lands.

Although in this embodiment an example case has been described where pixels adjoining in the nozzle column direction are printed with a large dot and a small dot, it is possible to use a combination of dots of other sizes than the above (for example, medium dot and small dot) or a combination of other colors. For example, a combination of dots of the same size but of different colors, such as large cyan dot and large magenta dot or a small cyan dot and small magenta dot, may also be used in this embodiment and still the intended effects of this invention can similarly be produced.

Fourth Embodiment

Now, the fourth embodiment of this invention will be described. In this embodiment, too, the printing apparatus explained in FIG. 1 and FIG. 6 is applied.

In this embodiment, too, the print head explained in FIG. 18 is used as in the third embodiment.

Figure 22:
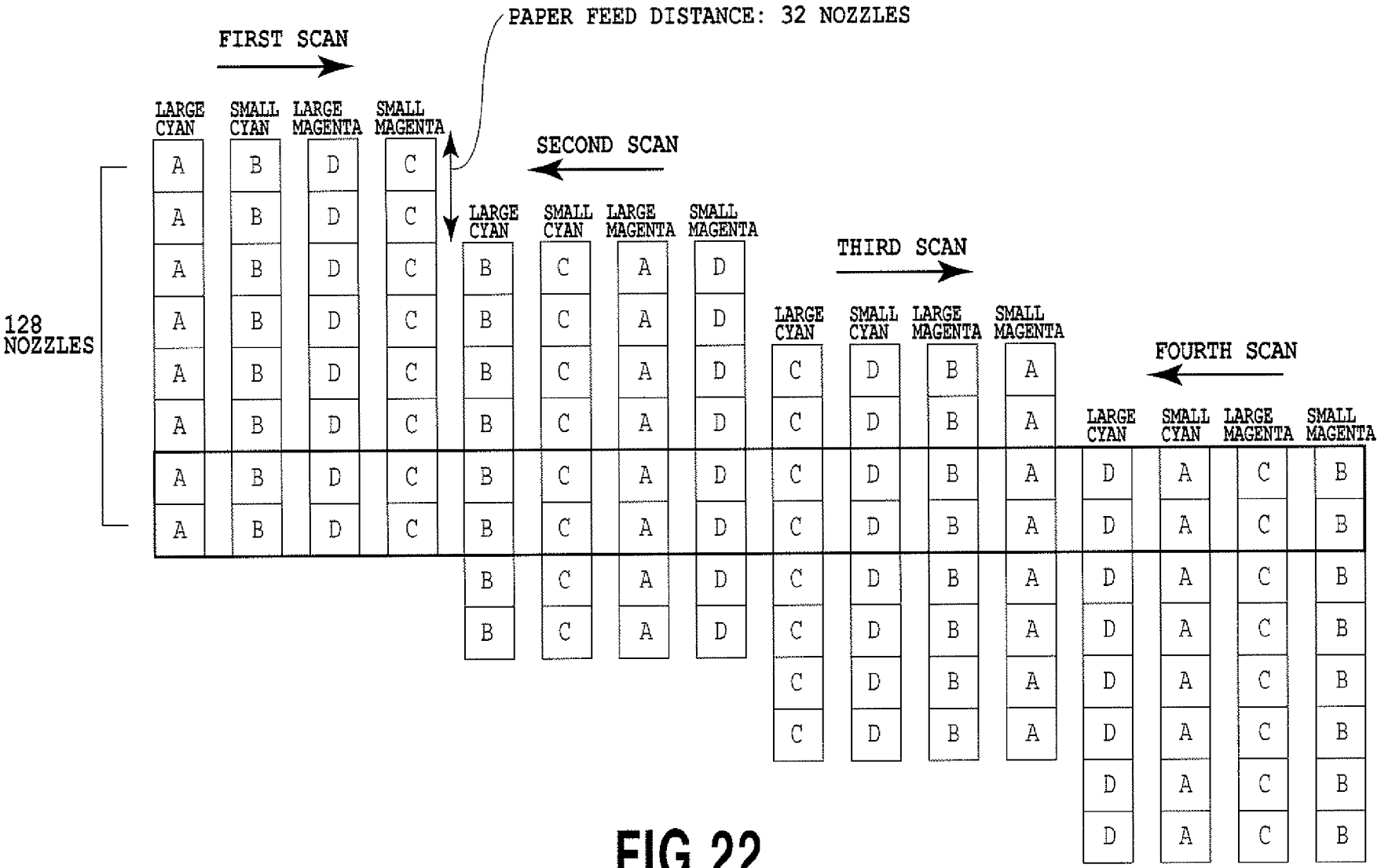
FIG. 22 is a schematic diagram showing mask patterns applied to a fourth embodiment of this invention.

FIG. 22 is a schematic diagram showing a mask pattern arrangement applied in this embodiment. Here are shown mask patterns to be applied to a total of four nozzle columns—a large cyan nozzle column and a small cyan nozzle column of the cyan column 902 and a large magenta nozzle column and a small magenta nozzle column of the magenta column 903—used in a 4-pass bidirectional multi-pass printing. The odd and even nozzle columns, each composed of 128 nozzles, have their nozzles divided into eight blocks of 16 nozzles in the sub scan direction, to each of which one mask pattern is applied. FIG. 22 shows four printing scans, first to fourth scan, and between each printing scan the print medium is fed a distance corresponding to two blocks. Here, the print head is shown to move relative to the print medium.

In FIG. 22, reference symbols A-D represent four different mask patterns that are exclusive and complementary to one another. That is, image to be printed on one image area on the print medium is completed by successively applying one of the four different mask patterns A-D to each of the four main printing scans. In this embodiment, too, the individual mask patterns A-D are random masks with no periodicity.

In the large cyan nozzle column, small cyan nozzle column, large magenta nozzle column and small magenta nozzle column, this embodiment uses different mask patterns in the same printing scan. For example, in the first scan of the figure, the large cyan nozzle column uses a mask pattern A, the small cyan nozzle column uses a mask pattern B, the large magenta nozzle column uses a mask pattern D, and the small magenta nozzle column uses a mask pattern C. In the second scan, these nozzle columns use different mask patterns than those of the first scan. The image data given to the individual nozzle columns are completely printed by the four main printing scans successively using the mask patterns A-D.

It is noted, however, that in a combination of large and small cyan nozzle columns, a combination of large and small magenta nozzle columns, a combination of large cyan and magenta nozzle columns, and a combination of small cyan and magenta nozzle columns, the same mask pattern is used always in the opposite main scan directions.

Figure 23:
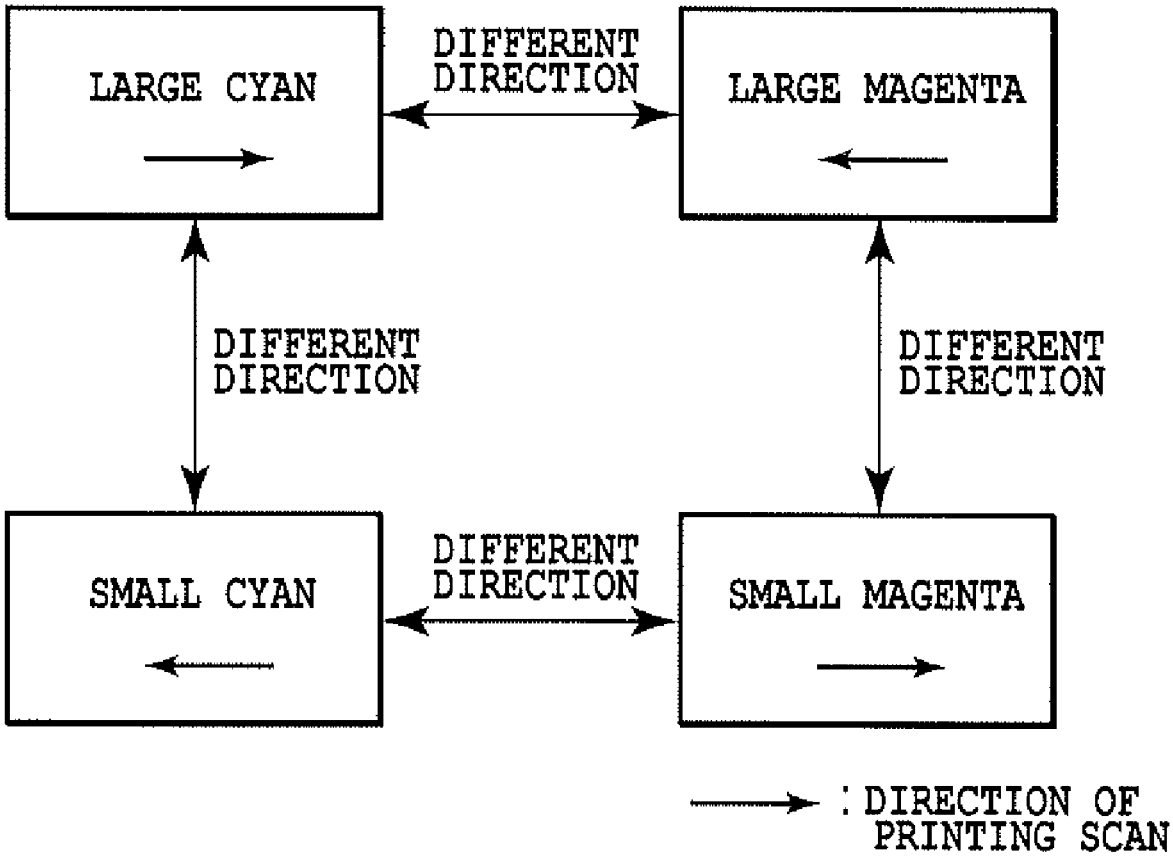
FIG. 23 is a diagram showing directions in which dots are printed through a mask pattern A in the fourth embodiment.

FIG. 23 schematically illustrates the above relationship. Although this figure shows the printing scan directions in the mask pattern A, the similar relation holds also in the mask pattern B, C and D.

Figure 24A:
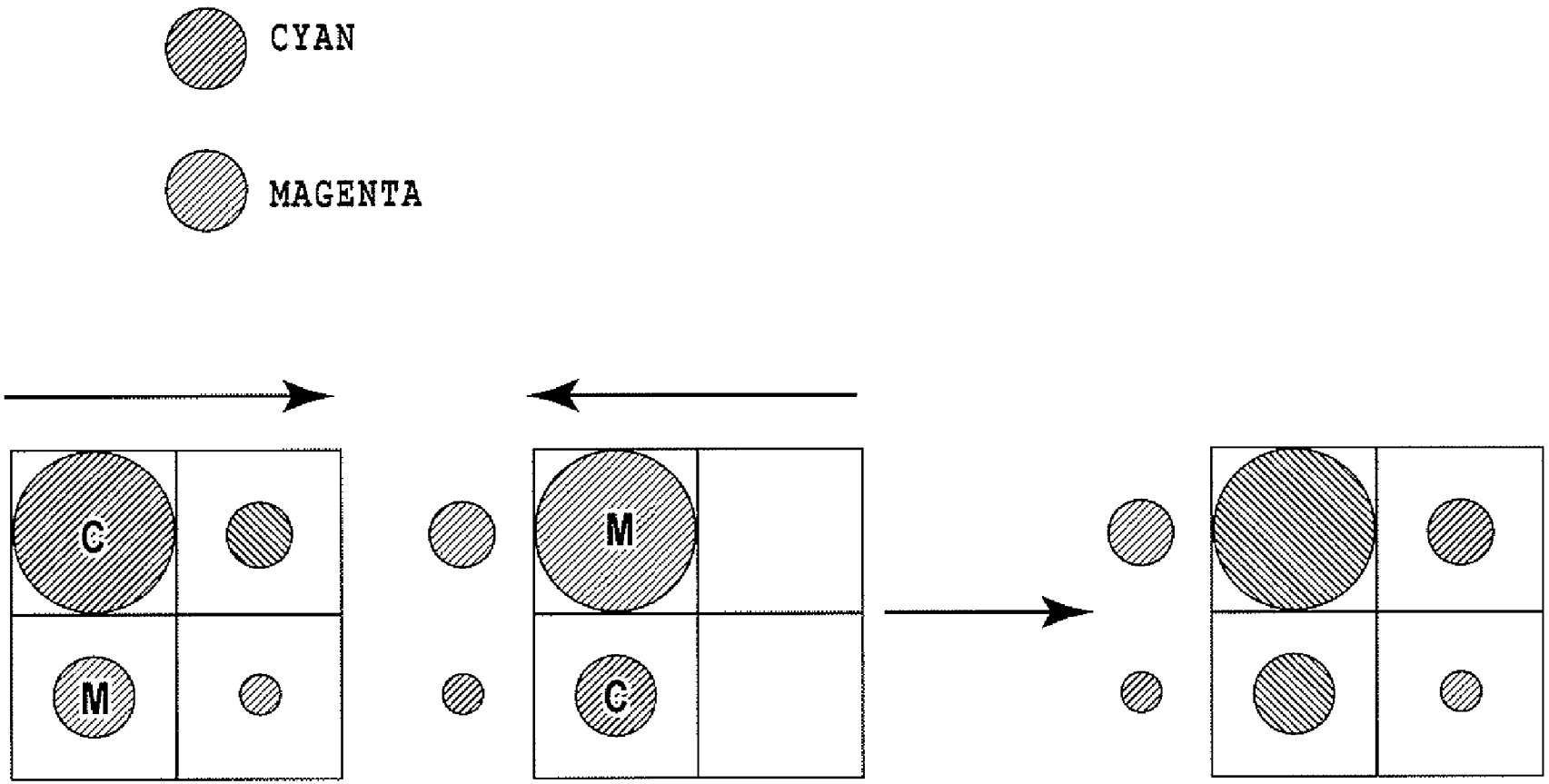
FIGS. 24A and 24B illustrate dot landing states when a blue is produced by using large dots and small dots and the mask of the fourth embodiment.
Figure 24B:
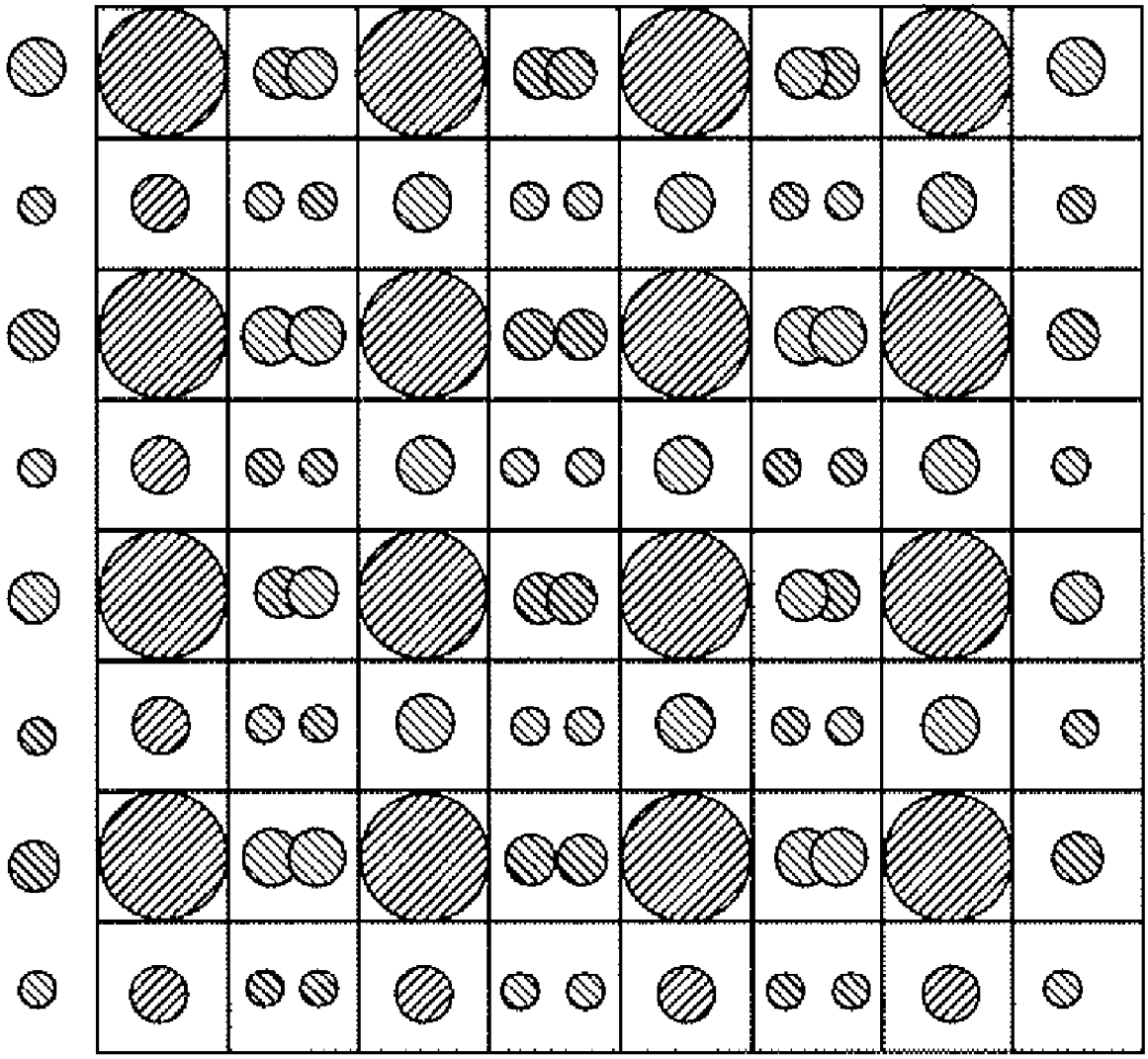

When such a mask pattern is employed, the dot landing state is as shown in FIG. 24A. That is, in a 1×2-pixel area comprising overlapping large cyan and magenta dots and overlapping small cyan and magenta dots, satellites of large dots and satellites of small dots land evenly scattered to the left and right of the main dots that are arrayed in the sub scan direction. As a result, a uniform image can be produced. FIG. 24B shows a printed state of this embodiment when seen in a wider area.

Figure 25A:
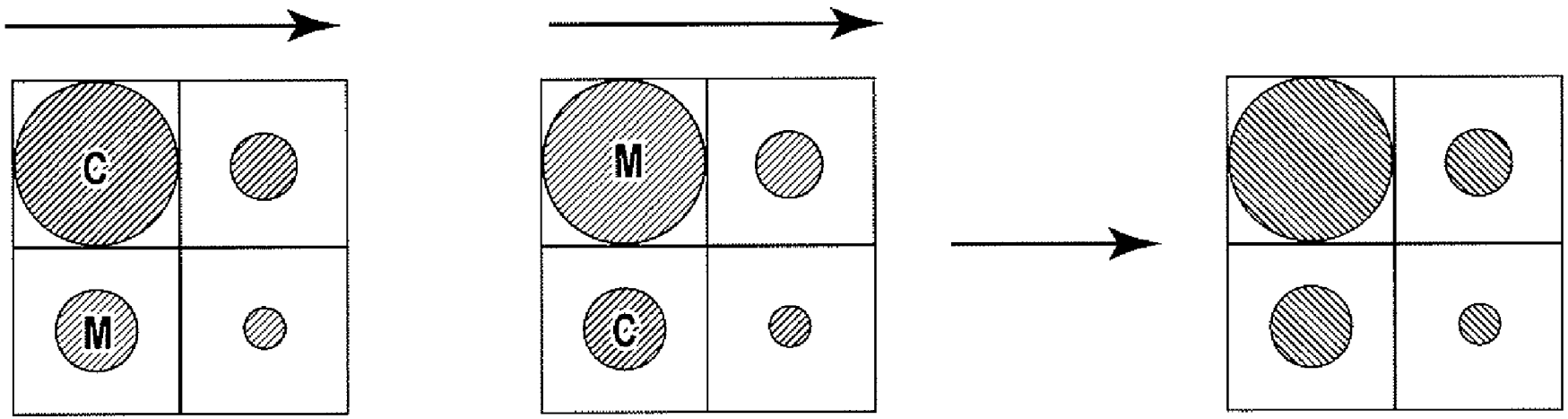
FIGS. 25A and 25B illustrate dot landing states when a blue is produced by using large dots and small dots and a conventional mask.
Figure 25B:
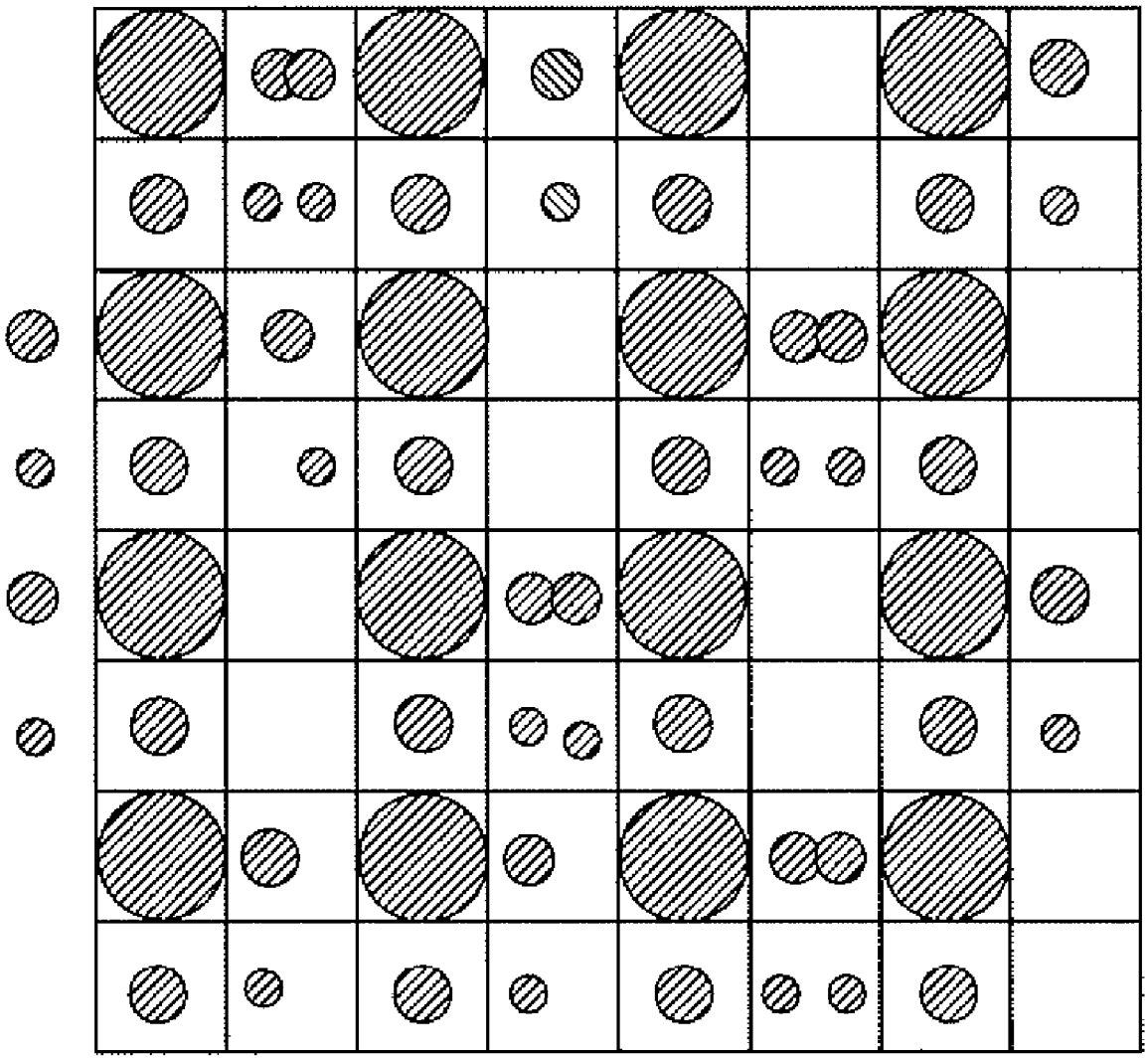

Satellites that land unevenly with respect to the main dots have adverse effects on the image being formed. FIG. 25A shows a landing state when a secondary color is printed by applying the same mask to the large and small cyan nozzle columns and the large and small magenta nozzle columns during the same scan. In a 2×2-pixel area, since dots on the same pixel are always printed in the same scan direction, satellites are printed on the same side of the main dots that are formed in the same pixel. FIG. 25B shows printed dots in a wider area. Compared with FIG. 24B, blank portions and satellite overlapping portions show up more distinctly, indicating that the satellite distribution is uneven.

The feature of this embodiment is that, even with a combination of nozzle columns to print dots of different sizes and a combination of nozzle columns to print dots of different colors, the positions where satellites are printed can be dispersed uniformly with respect to the main dots by properly selecting the order of mask patterns. While this embodiment has described the dot forming process by taking large and small cyan dots and large and small magenta dots for example, this invention is not limited to these dots. The similar effects can also be produced with combinations of nozzle columns of other colors and sizes.

The random mask pattern applied to the above embodiments should be broadly construed as a "mask pattern without as strong a periodicity as may be found with fixed mask patterns". Therefore the random mask pattern is not limited a pattern in which positions of print permission pixels are decided by randomly.

Furthermore, a mask pattern which can apply to this invention is not limited to a random mask pattern. For example, a mask pattern having no periodicity disclosed in Japanese Patent Application Laid-open No. 2002-144552 is able to be applied. Furthermore, a mask pattern which has no periodicity and contains little low-frequency components is applied acceptably.

This invention functions particularly effectively with a type of ink jet printing system that has a means to generate a thermal energy changing of state in ink (e.g., electrothermal transducers and laser beams) to eject. With this system, the ink ejection volume can be reduced, realizing an improved print density and resolution. The reduced ink ejection volume makes it easier for satellites, the subject of this invention, to emerge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation application of PCT application No. PCT/JP2006/313592 under 37 Code of Federal Regulations §1.53 (b) and the said PCT application claims the benefit of Japanese Patent Application No. 2005-200150 filed Jul. 8, 2005 which is hereby incorporated by reference herein in its entirety.

What is claimed is:

1. An ink jet printing apparatus for printing an image on a print medium by using a print head which can eject a first ink drop and a second ink drop, the second ink drop having the same color as and different size from the first ink drop, the ink jet printing apparatus comprising:

means for main-scanning the print head relative to the print medium in a forward direction and in a backward direction; and means for controlling ejections so that, when the first ink drop and the second ink drop are ejected toward the same pixel on the print medium, the first ink drop and the second ink drop are ejected in main scans of different directions;

wherein a satellite of the first ink drop ejected toward the same pixel lands shifted in the forward or backward direction with respect to main dots of the first and second ink drops that land on the same pixel and a satellite of the second ink drop lands shifted, with respect to the main dots of the first and second ink drops, in a direction opposite the direction in which the satellite of the first ink drop shifts.

2. The ink jet printing apparatus according to claim 1, further comprising:

dividing means for dividing a first image data to be printed by the first ink drop to an area on the print medium that can be printed by one time of the main scan into M pieces of divided image data for printing in M times of the main scan corresponding to the area, and dividing a second image data to be printed by the second ink drop to the area on the print medium that can be printed by one time of the main scan into M pieces of divided image data for printing in M times of the main scan corresponding to the area;

wherein the dividing means divides the first and second image data so that the ejections of the first ink and the second ink toward the same pixel can be executed in the main scans of different directions.

3. The ink jet printing apparatus according to claim 2, further comprising:

memory for storing a first mask patterns for dividing the first image data into M pieces and a second mask pattern for dividing the second image data into M pieces, wherein the dividing means divides the first image data into M pieces based on the first mask pattern and divides the second image data into M pieces based on the second mask pattern.

4. The ink jet printing apparatus according to claim 3, wherein the mask patterns have no periodicity.

5. The ink jet printing apparatus according to claim 3, wherein the first and second mask patterns are each patterns in which print permission pixels are arranged randomly.

6. An ink jet printing method for printing an image on a print medium by using a print head which can eject a first ink drop and a second ink drop, the second ink drop having the same color as and different size from the first ink drop, the ink jet printing method comprising the steps of:

main-scanning the print head relative to the print medium in a forward direction and in a backward direction; and controlling ejections so that, when the first ink drop and the second ink drop are ejected toward the same pixel on the print medium, the first ink drop and the second ink drop are ejected in main scans of different directions;

wherein a satellite of the first ink drop ejected toward the same pixel lands shifted in the forward or backward direction with respect to main dots of the first and second ink drops that land on the same pixel and a satellite of the second ink drop lands shifted, with respect to the main dots of the first and second ink drops, in a direction opposite the direction in which the satellite of the first ink shifts.

* * * * *